US005603258A

United States Patent [19]

Besaw

[11] Patent Number: 5,603,258

[45] **Date of Patent: *Feb. 18, 1997**

[54] CORRUGATED PALLET

[75] Inventor: Larry G. Besaw, Jasper, Ind.

[73] Assignee: The Servant's Inc., Jasper, Ind.

[ * ] Notice: The term of this patent shall not extend beyond the expiration date of Pat. No. 5,535,668.

[21] Appl. No.: 218,111

[22] Filed: Mar. 25, 1994

Related U.S. Application Data

[63] Continuation-in-part of Ser. No. 169,317, Dec. 17, 1993, Pat. No. 5,535,668.

[51] Int. Cl.[6] ..... B65D 19/00

[52] U.S. Cl. ..... 108/51.3

[58] Field of Search ..... 108/51.3, 51.1, 108/56.1, 56.3

[56] References Cited

U.S. PATENT DOCUMENTS

| | | | |
|---|---|---|---|
| 2,507,588 | 5/1950 | Brandon . | |
| 2,528,413 | 10/1950 | Budd . | |
| 2,631,724 | 3/1950 | Wright . | |
| 2,691,500 | 10/1954 | Baumann | 108/51.3 |
| 2,888,221 | 5/1959 | Connelly . | |
| 2,908,464 | 10/1959 | Traudt et al. . | |
| 2,953,339 | 9/1960 | Roshon . | |
| 2,996,276 | 8/1961 | Sorensen et al. . | |
| 3,055,624 | 9/1962 | Wilson . | |
| 3,071,045 | 1/1963 | Budd . | |
| 3,272,158 | 6/1964 | Baruum . | |
| 3,362,867 | 1/1968 | Wilkins . | |
| 3,407,758 | 10/1968 | Simkins . | |
| 3,425,367 | 2/1969 | Oravez | 108/51.3 |
| 3,520,258 | 7/1970 | Shepherd . | |
| 3,557,719 | 1/1971 | Gielas . | |
| 3,587,479 | 6/1971 | Geschwender | 108/51.3 |
| 4,015,544 | 4/1977 | Szutkowski . | |
| 4,228,744 | 10/1980 | Moore . | |
| 4,487,136 | 12/1984 | Beckway . | |
| 4,697,699 | 10/1987 | Schneider . | |
| 4,850,284 | 9/1989 | De Groot et al. . | |
| 5,129,329 | 7/1992 | Clasen | 108/51.3 |
| 5,194,558 | 2/1993 | Wozniacki | 108/51.3 |
| 5,195,440 | 3/1993 | Gottlieb | 108/51.3 |
| 5,327,839 | 7/1994 | Herring et al. | 108/51.3 |
| 5,370,062 | 12/1994 | Johnston et al. | 108/51.3 |
| 5,377,600 | 1/1995 | Speese et al. | 108/51.3 |
| 5,383,409 | 1/1995 | Hayakawa | 108/51.3 |
| 5,411,786 | 4/1995 | Kuo | 108/51.3 X |

*Primary Examiner*—José V. Chen

*Attorney, Agent, or Firm*—Middleton & Reutlinger; David W. Carrithers

[57] ABSTRACT

A lightweight, high strength disposable or recyclable corrugated pallet. The corrugated pallet is formed from one or more sheets of flat corrugated material, at least one of which is scored and cut to form a plurality of spaced apart opposing panels. The panels are hingedly connected to the primary sheet and folded downwardly normal to the bottom surface of the sheet(s) defining a pair of opposing panel support legs. A generally square aperture is formed in the surface of the sheet upon folding of the panels. A support member complementary sized and shaped according to the aperture formed in the sheet and the length of the opposing panel support legs is inserted through the aperture and secured between the pair of opposing panel support legs, preferably with an adhesive. The support member is formed from one or more layers of a narrow strip of corrugated material having a plurality of scores cut therein along the surface of one side for bending said strip into a generally square configuration. The flutes of the corrugated material comprising the support member and opposing panel support legs are oriented in the vertical plane to maximize the strength to weight ratio.

A corrugated leg wrap support member utilizing a sheet of corrugated material having a plurality of score lines is folded inwardly forming a generally rectangular conduit support member for use in combination with the corrugated pallet.

27 Claims, 25 Drawing Sheets

CORRUGATED PALLET

BACKGROUND OF THE INVENTION

This application is a continuation-in-part of U.S. patent application Ser. No. 08/169,317 filed on Dec. 17, 1993, now U.S. Pat. No. 5,535,668.

The present invention relates to pallets upon which materials are stacked for storage and transportation.

Pallets are used as a method of handling materials in large quantities. Pallets typically comprise a flat surface for supporting containers or packages a sufficient distance from the floor to permit the tines of the lift-truck forks to be inserted under them so that the pallet supporting the load can be moved from place to place. Pallets used for this purpose are fabricated from wood, metal, plastic, or combinations thereof. Conventional pallets fabricated from these materials are expensive to make and use due to the cost of the materials, cost of construction, and cost of disposal. Usually these conventional types of pallets have to be returned after the shipment to the shipper for reuse or the pallets had to be disposed of in a proper manner. Deposal of the conventional wood and nail pallets is a problem after exposure to chemical or biochemical materials which contaminate the pallet in that not all of the pallet materials of construction are destructible by incineration and often must be disposed in a hazardous waste landfill which is inconvenient and expensive.

The present invention eliminates several of the disadvantages associated with the use of permanent pallets. The present invention is comprised of inexpensive materials such as corrugated board or paperboard and an adhesive such as glue all of which may be generally recognized as safe, "GRAS", by the Food and Drug Administration, "FDA", so that they are recyclable, disposable in sanitary landfills, and inexpensive to manufacture. The corrugated pallet of the present invention is also easy to dispose of in case of contamination due to product spills or damage because all of the materials of construction are biodegradable and/or can be incinerated without further disassembly, yet they are reusable for many purposes. The corrugated pallets are light in weight and have great structural strength. Thus, the corrugated pallets of the instant invention are especially suited for assembly line work for containing or supporting parts which must be supported or stacked in that the worker need not have to handle the weight of a traditional wood and nail pallet. Moreover, the manufacturer does not have the expense of providing a light weight plastic pallet which are usually too costly to use for operations requiring disposal or destruction of the pallet due to contamination.

Accordingly, it is a principal object of the present invention to provide a disposable and recyclable corrugated pallet of the lowest possible cost while maximizing its strength and durability.

It is an object of the present invention to provide a disposable pallet capable of manufacture solely from lightweight sheet material such as corrugated board and an adhesive.

It is an object of the present invention to provide leg support members comprised of corrugated material to support the pallet high enough above a surface to accommodate the tines of a fork lift.

It is another object of the present invention to construct the pallet with the supporting members being positioned to dissipate the weight of the load on the pallet evenly.

It is yet another object to construct the pallet so that it will sustain loads to which it is subjected and not fold or bend sideways in movement or shipment.

SUMMARY OF THE INVENTION

In order to provide a corrugated pallet having the above characteristics, the present invention comprises a support surface consisting of at least one flat sheet of single or double ply corrugated material supported by a plurality of supporting members or legs formed from corrugated material. In one preferred embodiment, "I" shaped perforations are formed and interconnected with straight score lines along a template formed in the flat sheet of material. Aligning and pressing the support members through the primary support sheet detaches the cut portions of the panels integrally formed therein which biases the panels forming flaps extending against opposite sides of the support members. Coating of the template prior to insertion of the support members through the scored panel formed in the primary support sheet provides a means of simultaneously applying an adhesive between the panels and the support members.

More particularly, the present invention entails a corrugated pallet comprising a primary support sheet surface of flat corrugated material having a plurality of opposing panels formed therein. The opposing panels are hingeably connected to the primary support sheet. Each of the opposing panels are folded downward normal to the surface of the primary support panel to define a supporting leg. A support member is fastened inbetween or around each of the support legs, wherein the support member comprises a strip of corrugated material having a plurality of scores cut therein for bending the strip into a square or block complementary sized for insertion into or around the supporting legs, and extending the length of the supporting legs. Moreover, a means such as an adhesive is provided for fastening the support members to the support legs providing multiple layers of single or multiple ply corrugated material for supporting the load bearing primary support panel.

Furthermore, an alternate embodiment of the present invention consists of a corrugated leg-wrap pallet comprising a support surface comprising at least one multi-ply corrugated sheet, and at least two leg-wrap support members secured to the bottom of the support surface. The leg-wrap support members comprise a multi-ply corrugated sheet having a plurality of spaced apart parallel score lines formed therein with the sheet being folded inwardly forming creases along said score lines and at least five panel sections thereinbetween forming a generally rectangular shaped conduit having at least two of the panel sections overlapping and secured together. Moreover, the leg-wrap support has at least two spaced apart and aligned transverse slots formed through the sides of the leg-wrap support normal to the longitudinal axis of the leg-wrap support complementary sized and shaped and adapted to accommodate the tines of a lift truck. A plurality of generally square corrugated support members are disposed inside of the leg-wrap support and positioned between the slots for additional structural support.

Furthermore, the corrugated leg-wrap pallet may have a support surface extended in length and having a pair of spaced apart parallel score lines forming an inner side panel and outer side panel on each side of the support surface. The inner side panel and the outer side panel may be folded inwardly and wrapped around the leg-wrap support members forming side rails supports extending along each side of the support surface.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

The corrugated pallet 10 of the present invention is designed using one of more layers of single or multiple plies of semi-rigid material such as corrugated board, fiberboard, corrugated plastic sheets for the fabrication of inexpensive disposable skids. It is contemplated that the sheet material may be coated with oil, wax, a surfactant, or a polymer film to repel moisture. The semi-rigid material is typically cut into sheets and strips of material fastened together preferably with an adhesive, such as a glue, or by staples, rivets, or other fastening means. The sheet material is fed into a die which makes the cuts and score lines for the number of foldable panel legs required for the load capacity of a particular pallet.

Figure 1:
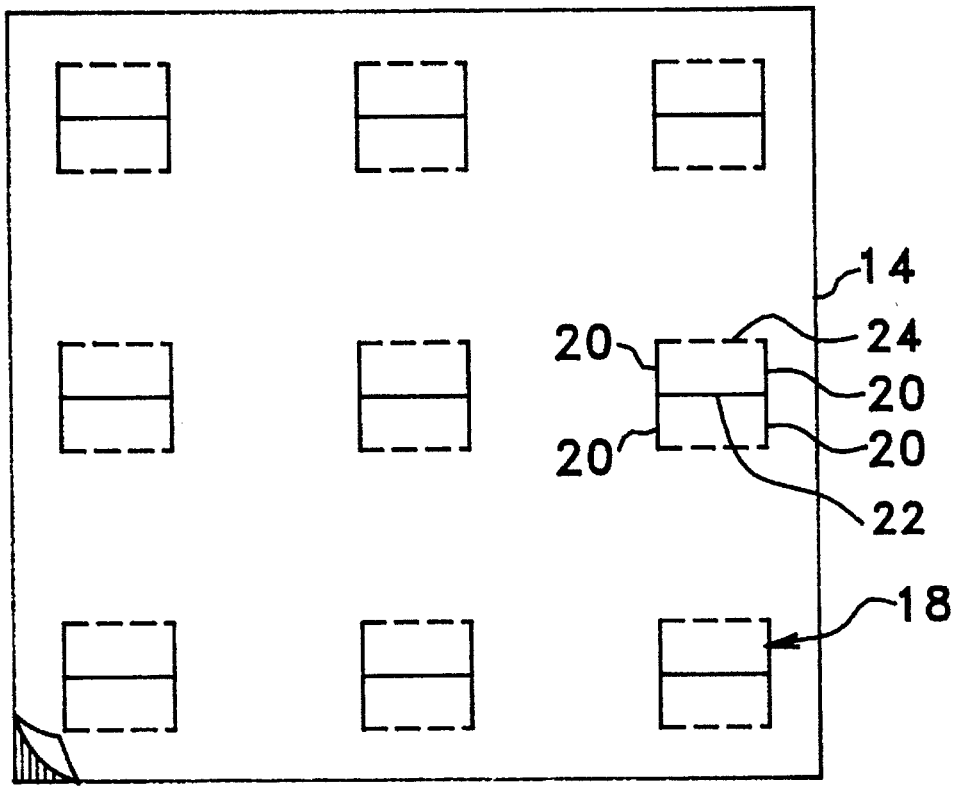
FIG. 1 is a plan top view showing the perforations cut through and scores lines formed in the surface of a corrugated sheet of material forming a template in the primary support sheet of the present invention.
Figure 2:
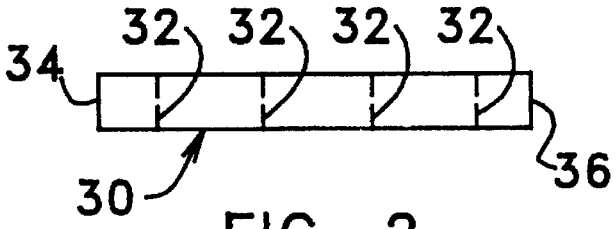
FIG. 2 is a front plan view showing a strip of corrugated material having a plurality of perforations and scores therein for foldably forming a support member of the present invention.
Figure 3:
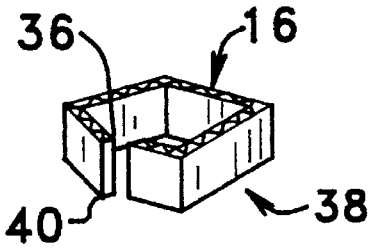
FIG. 3 is an elevational perspective view of a support member of the present invention.

As shown in FIGS. 1–9, one preferred embodiment of the present invention comprises a single sheet corrugated pallet 12 having at least one first primary support sheet 14 comprising a single sheet of fluted single, double, triple, quadruple, or multiple plies of corrugated board supported by a plurality of support leg members 16. FIG. 1 shows the primary support sheet 14 of one preferred embodiment including a plurality of foldable panels 18 each one being defined by a pair of parallel cut lines 20 on each side opposite one another and intersecting with a center cut line 22 in the general shape of an "I". Moreover, perforations forming score lines 24 are formed in the primary support sheet 14 intersecting the distal ends of each of the cut lines 20 for hingeably joining the generally rectangular or square panels 18 formed therein to the primary support sheet 14.

The support members 16 are likewise made of strips 30 of double fluted corrugated board having four score lines 32 spaced apart from one another normal to the longitudinal axis. The strips 30 are folded into square or rectangular formation so that the distal ends 34 and 36 respectfully join at a point 40 between the corners, preferably in the center section of the square support member 16. The wall thickness and size of the support members 38 vary depending upon the weight of the load supported and the number of support members 16 utilized.

Figure 4:
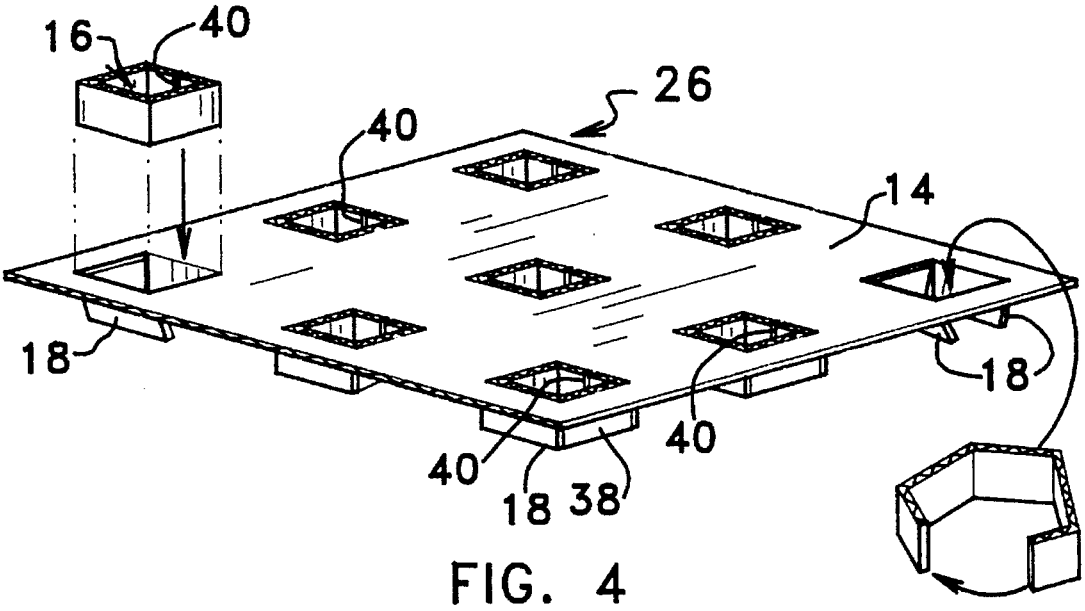
FIG. 4 is an elevational perspective view showing insertion of support members through the template cut and scored in the primary support sheet pushing the portion of the primary support sheet along the center-cut downward and simultaneously bending the primary support sheet along the crease scored therein.
Figure 5:
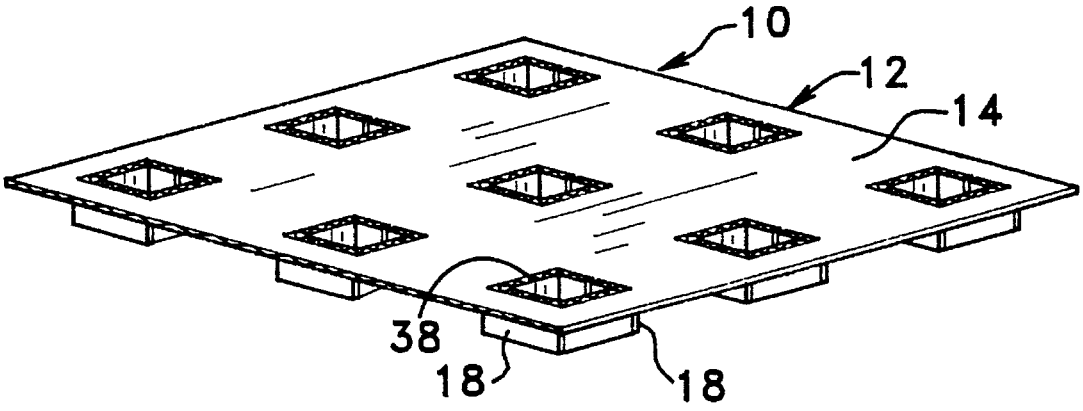
FIG. 5 is an elevational perspective view showing the single sheet corrugated pallet of the present invention.

As best illustrated in FIG. 4, exertion of pressure upon the surface of the panel template by insertion of a support member 16 forces the foldable panels 18 downward opposite one another and normal to the surface of the primary support sheet 14 forming a pair of opposing panel legs 26. The support members 16 are rotated and positioned between the panel legs 26 so that the point 40 of junction of the distal ends 34, 36 of the support member 16 are adjacent and contiguous with one side of one of the foldable panels 18.

Figure 23:
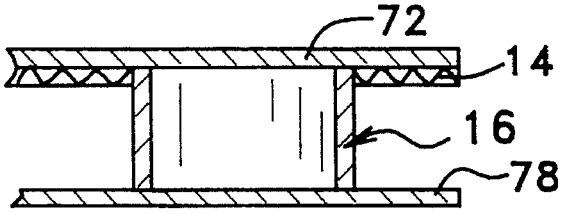
FIG. 23 is a sectional view taken along lines 23—23 showing the sides of the support member disposed between a pair of foldable panels.
Figure 24:
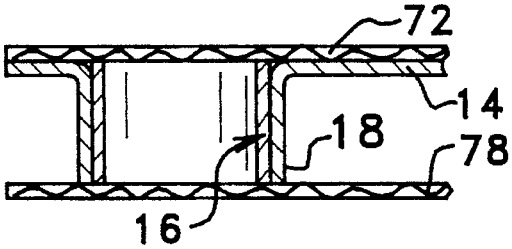
FIG. 24 is a sectional view taken along lines 24—24 showing the sides of the support member between the sides of the primary support sheet panels.
Figure 29:
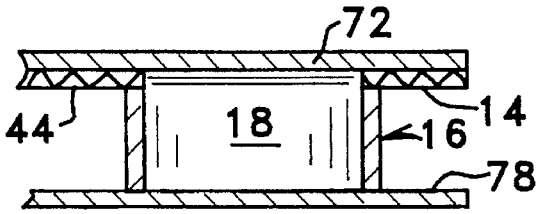
FIG. 29 is a sectional view taken along lines 29—29 showing the sides of the support member around the panels.
Figure 30:
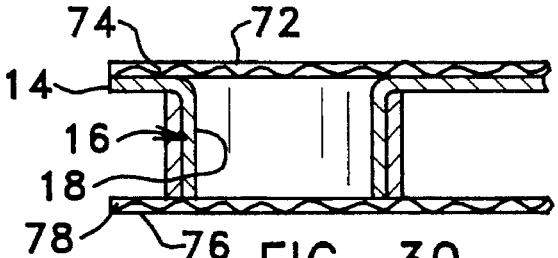
FIG. 30 is a sectional view taken along lines 30—30 showing the sides of the support member surrounding the sides of the primary support sheet panels.

The support members 16 may be attached to the panel legs 26 by various fastening means such as by staples, rivets, tape, interlocking tabs, or clips; however, in the preferred embodiment, a glue, preferably a water soluble glue, is used as an adhesive to hold the opposing panel legs 26 securely to the support members 16. In the preferred embodiment, the support leg members 16 are sized and shaped to provide a complementary fit with the panel legs 26. Insertion of the support members 16 within the panel legs 26 provides a reinforcing structure in that the depth of the support member 16 extends the length of the panel legs 26 and the thickness of the primary support panel 14 in order to provide optimal support for the load such as best shown in FIGS. 23–24. Surrounding or wrapping the panel legs 26 with a support member 16 provides a reinforcing structure in that the depth of the support members 16 extends the length of the panel legs 26 less the thickness of the primary support panel 14, so that the top edge of the support members 16 support the bottom surface of the primary support panel 14 around the opening formed by the panels 18 to provide optimal support for the load and alleviate stress at the junction of the panel legs 26 to the primary support panel 14 such as is shown best in FIGS. 29–30. However, it is contemplated that the support members 16 may be of a depth of either more or less than that of the primary support panel providing lateral side to side support and providing an edge or sidewall between the panel legs 26 and the supporting member to facilitate stacking of the corrugated pallets 10 one upon another such as is shown in FIGS. 37–40.

Figure 6:
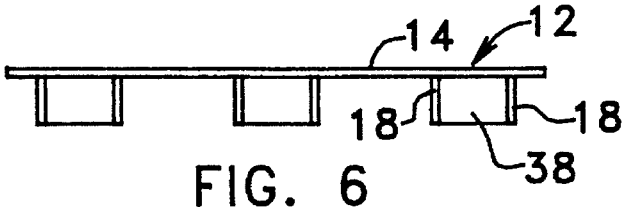
FIG. 6 is an elevational side view of the single sheet corrugated pallet showing the edges of the foldable panels comprising the support legs.
Figure 7:
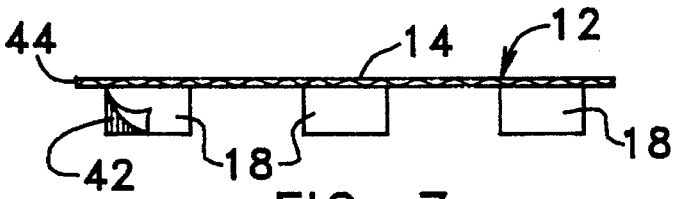
FIG. 7 is an elevational end view of the single sheet corrugated pallet of FIG. 1 showing the orientation of the panel flutes in alignment with the flutes in the primary support sheet.

Moreover, as shown in FIG. 4, an adhesive such as water soluble or biodegradable glue is applied to the template surface of the primary support sheet 14 before insertion of the support member 16. Insertion of the support members 16 through the primary support panel 14 distributes the adhesive onto the surface of the support members 16 as the support members 16 are pushed through the marked template. FIG. 6 shows a side view of a single sheet corrugated pallet 12 showing the leg panels 16 secured to opposing sides of a support member 38. FIG. 7 shows an end view of a single sheet corrugated pallet wherein the flutes 42 of the foldable panels 18 are aligned with the flutes 44 of the primary support sheet 14 so that the foldable panel flutes 42 extend normal to the supporting surface.

Figure 8:
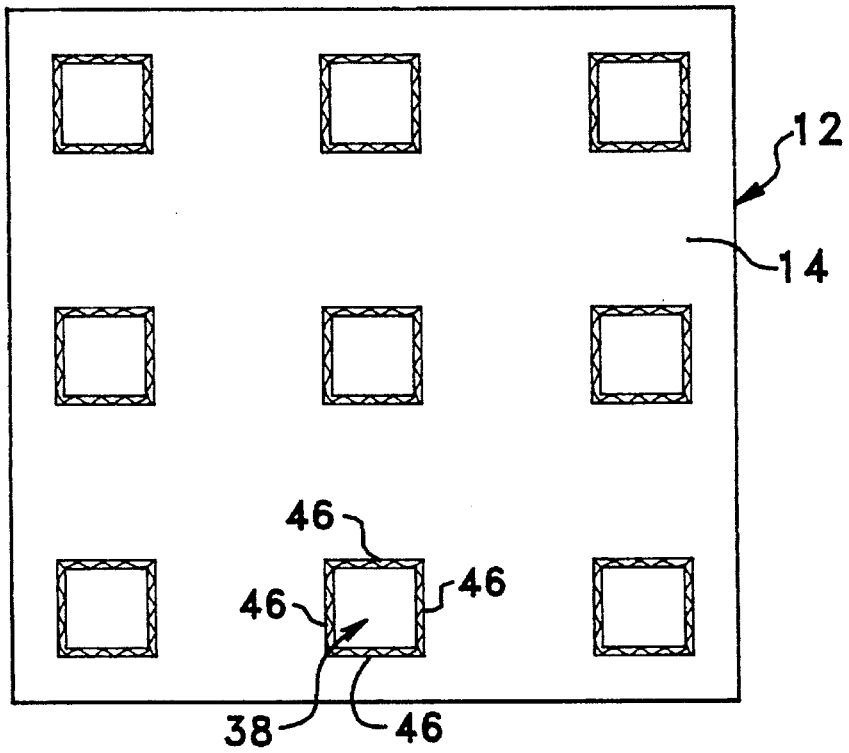
FIG. 8 is a plan top view of the single sheet corrugated pallet showing the fluted ends of the support members extending through the openings formed in the primary support sheet.
Figure 9:
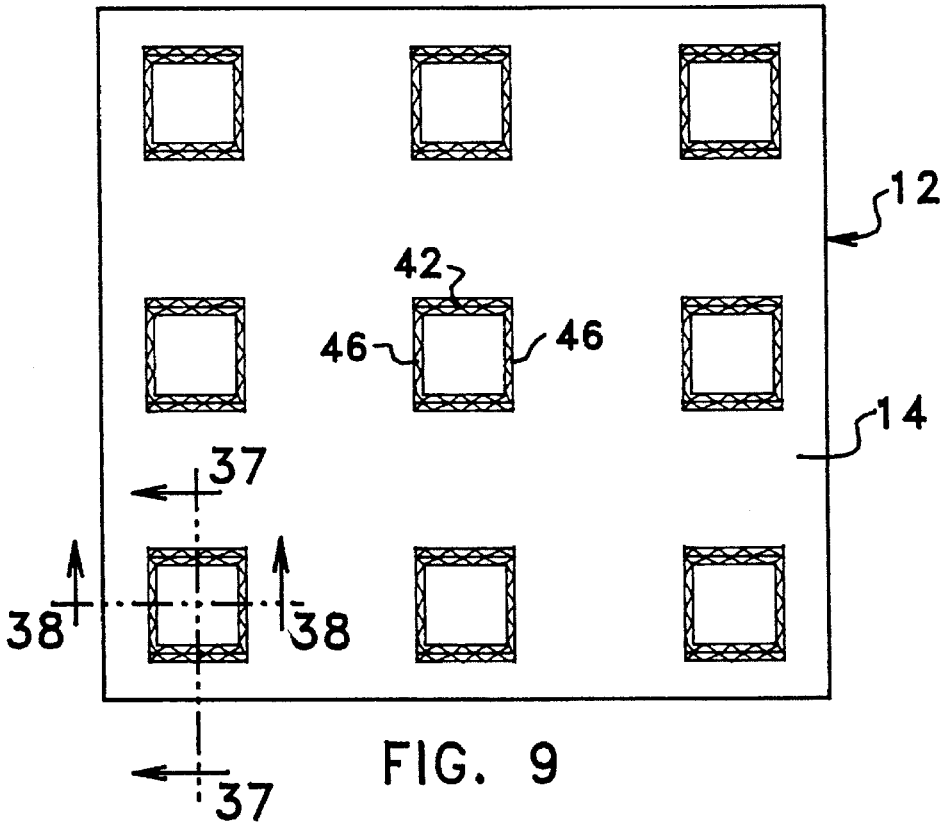
FIG. 9 is a plan bottom view of the single sheet corrugated pallet showing the fluted ends of the support members between the fluted panel ends.

FIG. 8 shows a plan top view of flutes 46 of the support members 38 extending through the primary support sheet 14. FIG. 9 is a plan bottom view of the single sheet corrugated pallet 12 showing the fluted ends 46 of the support members 38 between the flutes 44 of the foldable panels 18. Furthermore it is contemplated that several layers of multiple ply sheets may be adhesively connected forming layers of corrugated sheets in combination with the primarily panel 14 and support members 16 having multiple layers of fluting to provide the desired strength required for a particular load carrying application.

Figure 10:
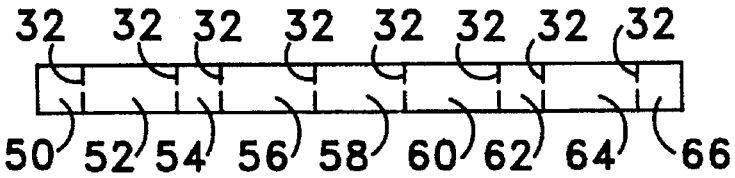
FIG. 10 is a front plan view showing a strip of corrugated material having a plurality of perforations therein forming score lines for foldably forming a support member having a reinforcement of a single sheet corrugated pallet.
Figure 11:
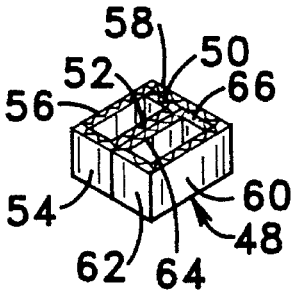
FIG. 11 is an exploded perspective view showing a reinforced support member of a single sheet corrugated pallet.
Figure 12:
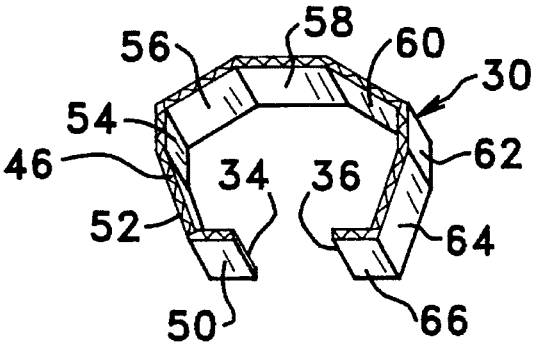
FIG. 12 is an elevational perspective view showing a reinforced support member of a single sheet corrugated pallet.
Figure 13:
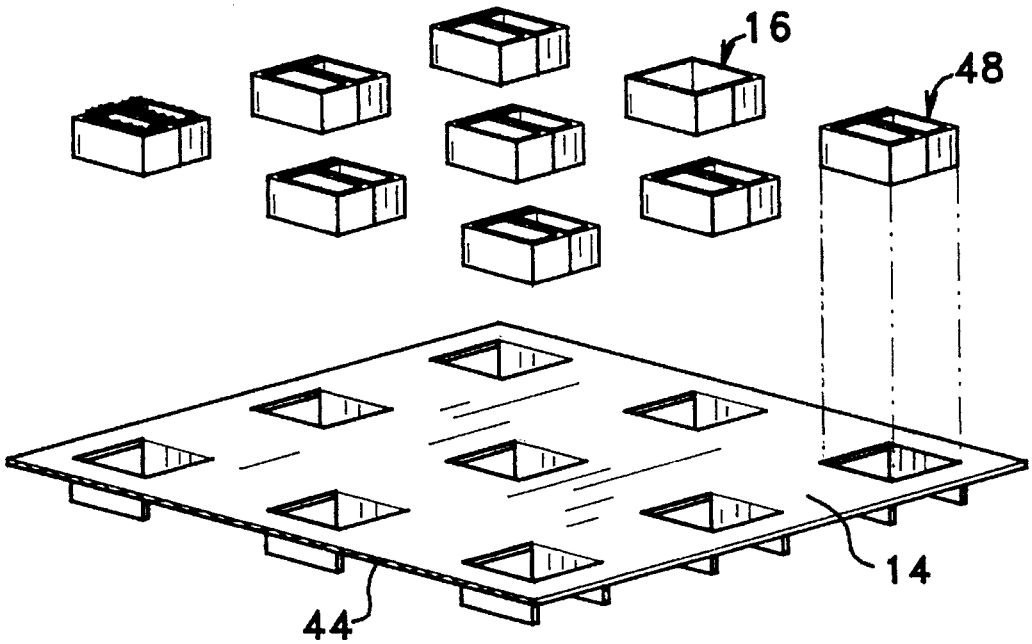
FIG. 13 is an exploded perspective view showing alignment of the reinforced support members with the panels formed within the primary support sheet of a single sheet corrugated pallet.

FIGS. 10–12 show an alternate embodiment of a reinforced support member 48 fabricated from a strip 30 of corrugated material having eight score lines 32 extending normal to the longitudinal axis of the strip 30 forming strip sections (50, 52, 54, 56, 58, 60, 62, 64, and 66). The distal ends 34 and 36 are folded inwardly so that the outer surface of strip sections 50 and 66 are contiguous with and adhesively secured to the inner surface of strip section 58 thereby forming a "T"-shaped double layer reinforcing means within the reinforced support member 48. The reinforced support members 48 may be inserted into the primary support panels 14, 48 instead of, or in addition to the square support members 16 such as is shown in FIG. 13.

Figure 14:
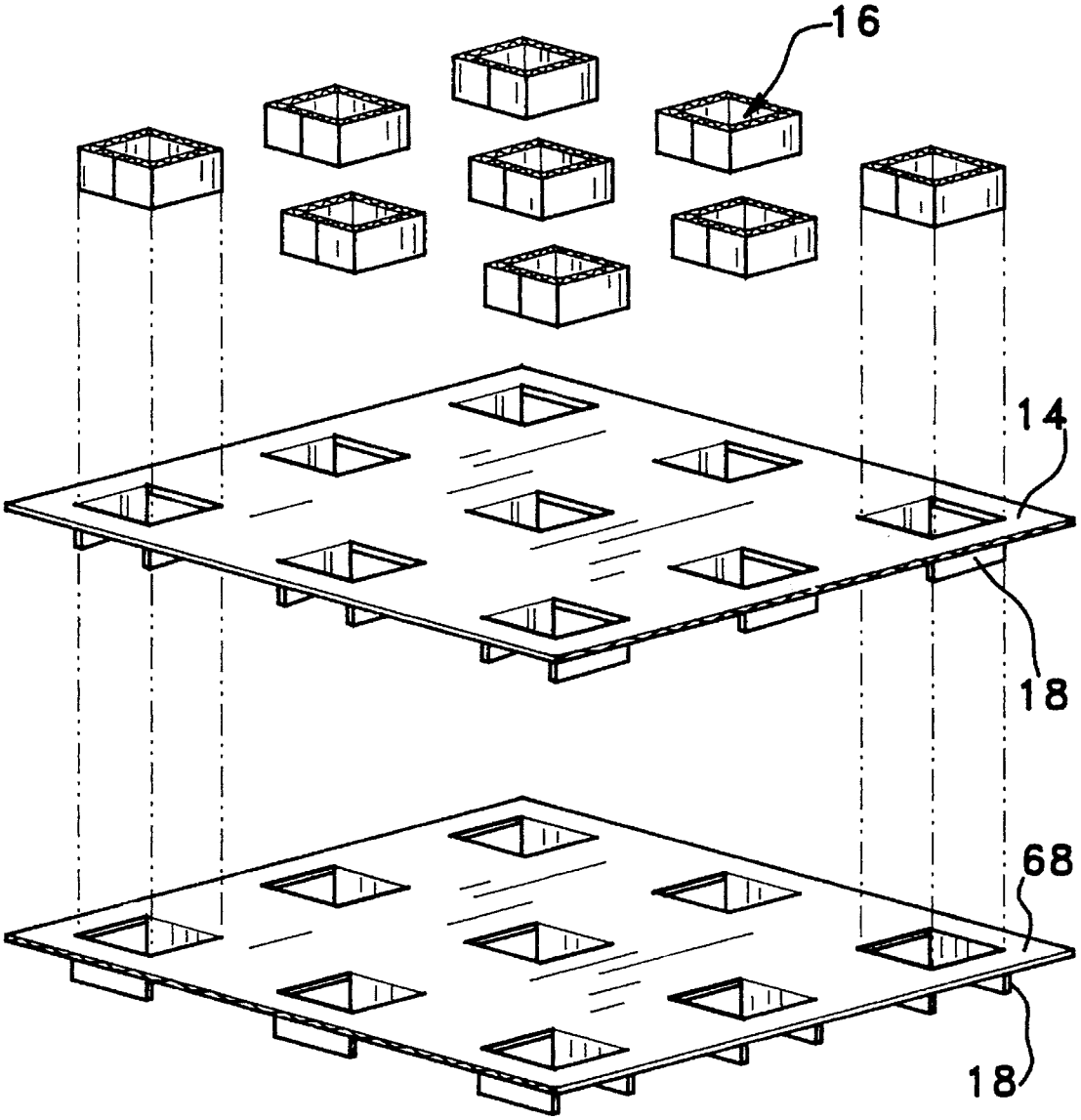
FIG. 14 is an elevational perspective view showing insertion of support members through the template cut and scored in a first primary support sheet and a second primary support sheet rotated on its axis 90 degrees with respect to the first primary support sheet, pushing the portion of the primary support sheets along the centercut downward and simultaneously bending the primary support sheets along the crease scored therein forming four panel legs.
Figure 15:
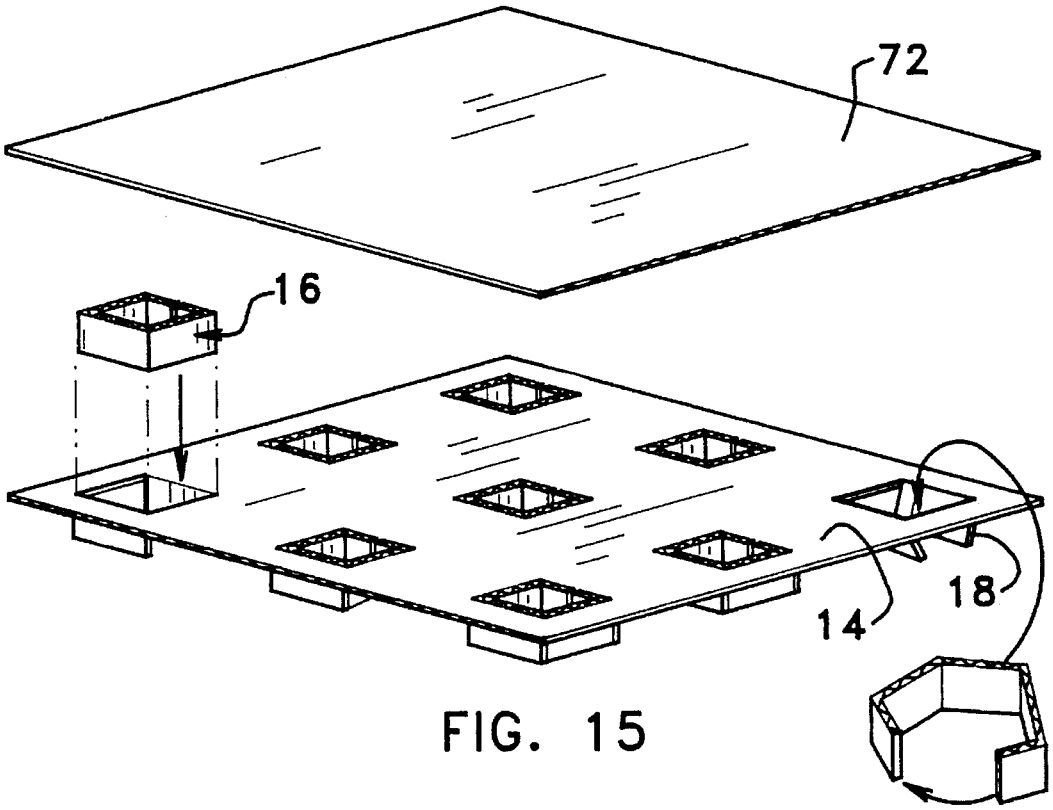
FIG. 15 is an exploded perspective view showing alignment of a support member between the panels formed in the primary support sheet and the alignment of a top cover sheet forming a double sheet laminated corrugated pallet.

A second primary support sheet 68 having identically panel templates formed by parallel cut lines 20, center cut lines 22 and score lines 32, may be rotated 90 degrees with respect to the first primary support sheet 14 so that the cut and score lines of one sheet are perpendicular to the same cut and score lines of the other sheet. An adhesive is applied to the top surface of the first primary support sheet 14 forming the bottom sheet. The second primary support sheet 68 is stacked upon the first primary support sheet 14 such that the squares of one are vertically juxtaposed upon the squares of the other sheet as shown in FIG. 14. Insertion of the support members 16, 48 through the sheets 14 and 68 depresses the foldable panels 18 downwardly and simultaneously spreads the adhesive from the surface of the first primary support panel 14 and/or second primary support panel 68 onto the outer surface of the support member 16 to securely hold the support member securely thereinbetween the four panel legs 26. This design forms a double sheet corrugated pallet 70 which maximizes the strength of the skid while minimizing the weight of the corrugated pallet 10.

Figure 16:
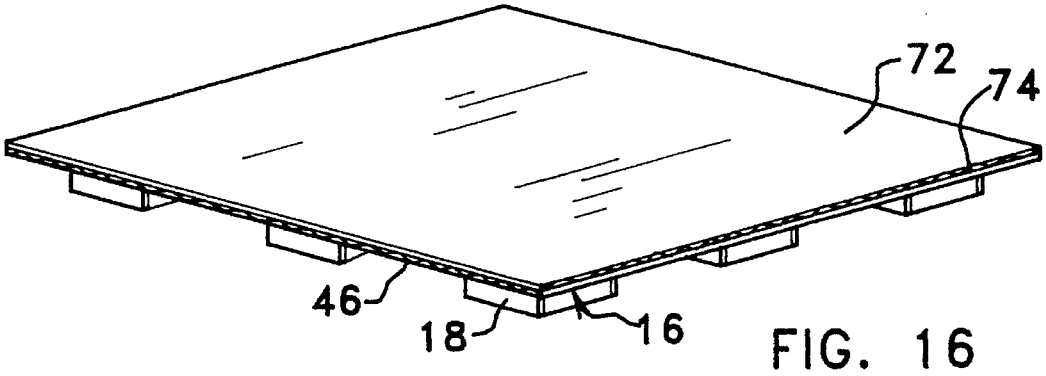
FIG. 16 is an elevated perspective view showing a double sheet laminated corrugated pallet of FIG. 16.
Figure 17:
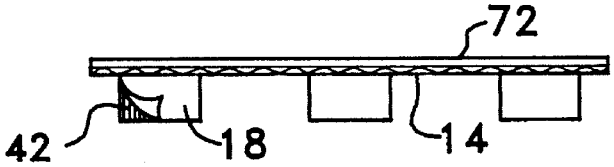
FIG. 17 is an elevational end view of the double sheet laminated corrugated pallet showing the orientation of the panel lutes of the top sheet in alignment perpendicular with respect to the lutes in the primary support sheet.
Figure 18:
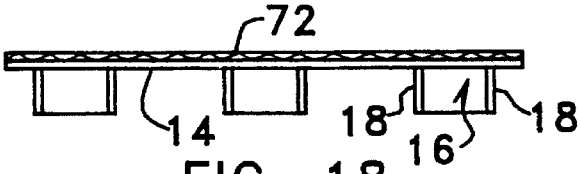
FIG. 18 is an elevational side view of the double sheet laminated corrugated pallet showing the edges of the panels attached to the support members.

As shown in FIGS. 15–18, an alternate embodiment of the present invention employs a first top double fluted multi-ply laminate support sheet 72 as a top cover sheet adhesively bonded to the surface of the primary support sheet 14, 68, and the fluted edges 46 of the corrugated support members 16, 48. The top support sheet 72 is usually rotated 90 degrees before adhesion to the primary support sheet 14 or 68 so that the laminate sheet flutes 74 run perpendicular to the primary support sheet flutes 44 to maximize the strength of the corrugated pallet 10 as shown in FIG. 16. The primary support sheet flutes 44 run parallel with the foldable panel flutes 42 as illustrated in FIG. 17 and 18.

Figure 19:
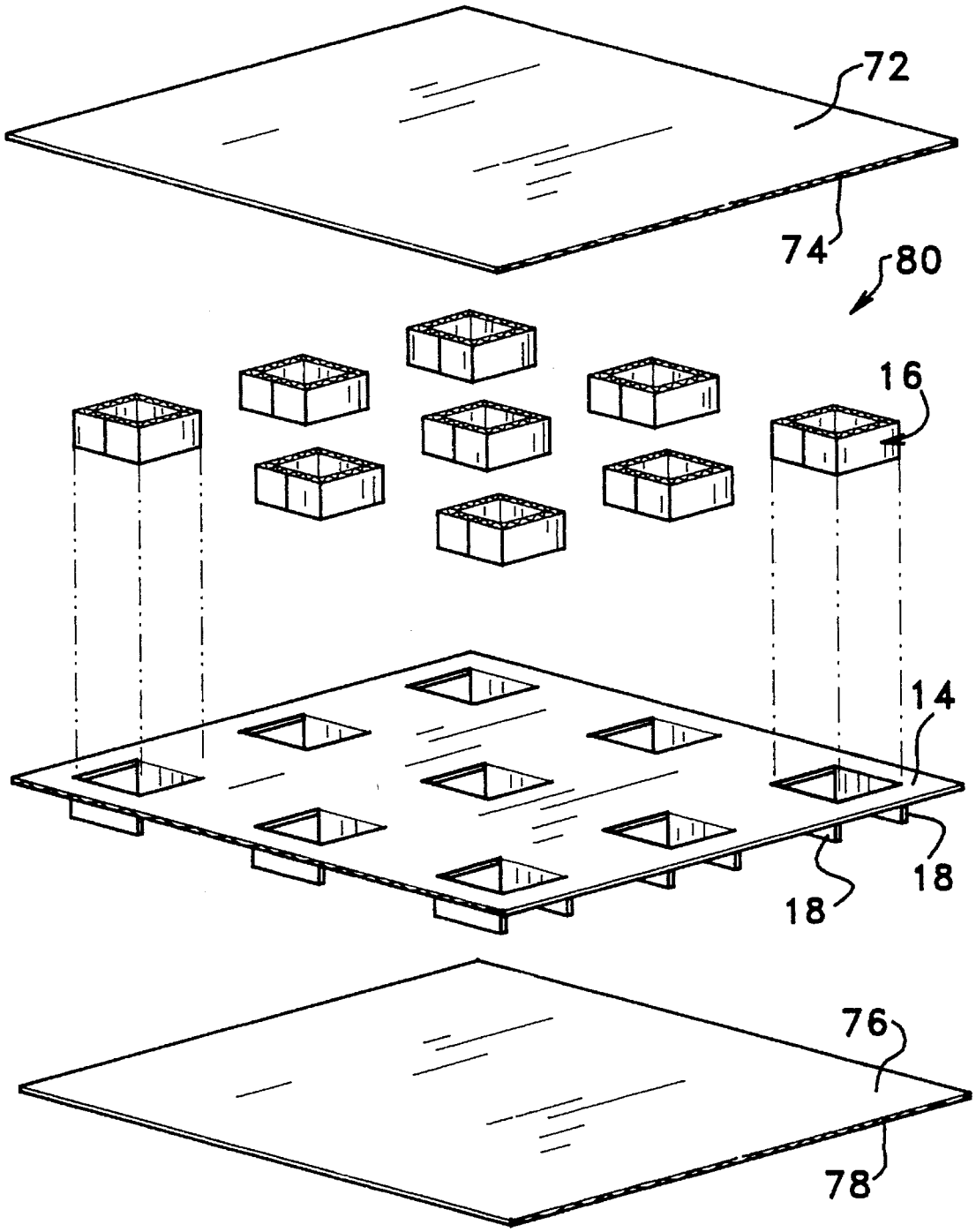
FIG. 19 is an explored perspective view showing alignment of a support member between the panels formed in the primary support sheet, and the alignment of a top cover sheet and bottom base sheet forming a triple sheet laminated corrugated pallet.
Figure 20:
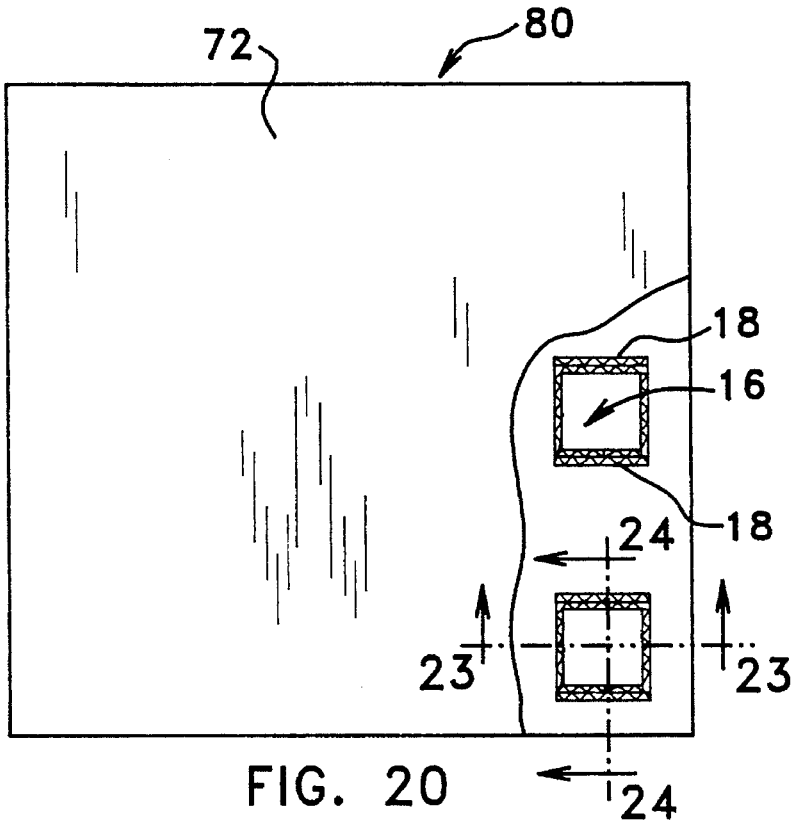
FIG. 20 is a top plan view of FIG. 19 depicting a cut-away section showing the flutes of the primary support sheet panels and support members therein.
Figure 21:
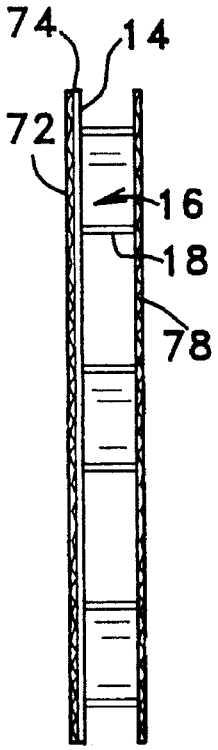
FIG. 21 is a right side view of FIG. 19 showing the flutes of the top cover sheet running parallel with the panels of the bottom base sheet and normal to the flutes of the primary support sheet.
Figure 22:
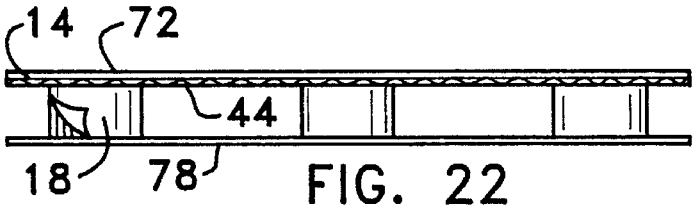
FIG. 22 is an end view of FIG. 19 showing the primary support sheet and panel flutes.

Moreover, as shown in FIG. 19, a fluted multi-ply base sheet 76 may also be adhesively secured to the edges of the panel legs 28 and edges of the support members 16 secured therein forming a triple sheet corrugated pallet 80. As with the top sheet, the base sheet 76 is usually rotated 90 degrees before adhesion to the primary support sheet 14, 68 so that the laminate sheet flutes 74 run perpendicular to the primary support sheet flutes 44 to maximize the strength of the triple sheet corrugated pallet 80. As illustrated in FIG. 21, the first laminate sheet flutes 74 run parallel with the base sheet flutes 78 opposite the primary support sheet flutes 44 and foldable panel flutes 42 as shown in FIGS. 22–24.

An alternate embodiment of the present invention is shown in FIGS. 25–30, comprising a base sheet 76 adhesively secured to the edges of the panel legs 28 and edges of the support members 16 adhesively secured around the panel legs 28 forming a triple sheet laminated corrugated pallet 80. The top laminate support sheet 72 and the base sheet 76 are generally rotated 90 degrees before adhesion to the primary support sheet 14, 68 so that the laminate sheet flutes 74 run perpendicular to the primary support sheet flutes 44 to maximize the strength of the triple sheet corrugated pallet 80. As illustrated in FIGS. 25–30, the first laminate sheet flutes 74 run parallel with the base sheet flutes 78 opposite the primary support sheet flutes 44 and foldable panel flutes 42.

Figure 25:
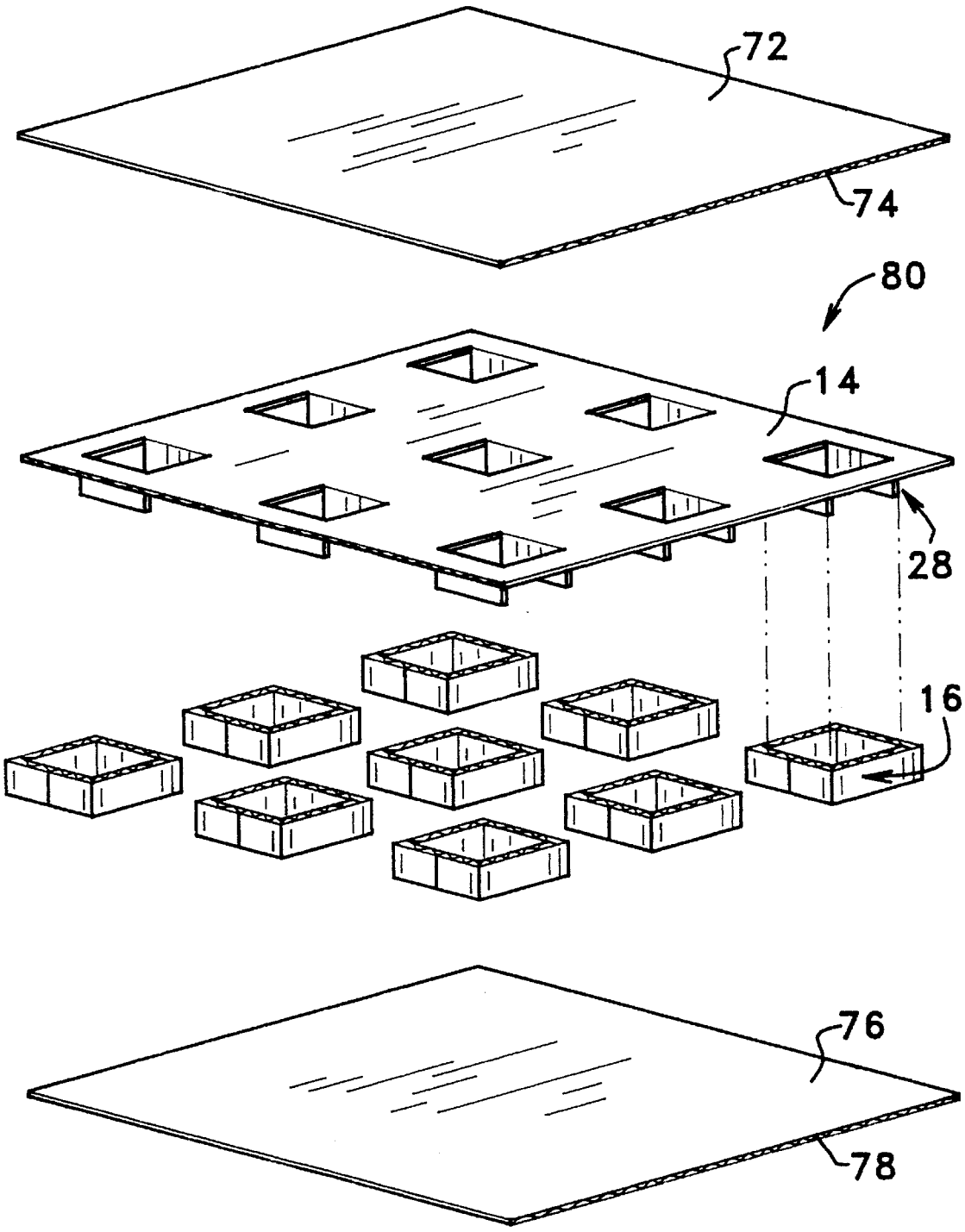
FIG. 25 is an explored perspective view showing alignment of support members around the panels formed in the primary support sheet, and the alignment of a top cover sheet and bottom base sheet forming a triple sheet laminated corrugated pallet.
Figure 26:
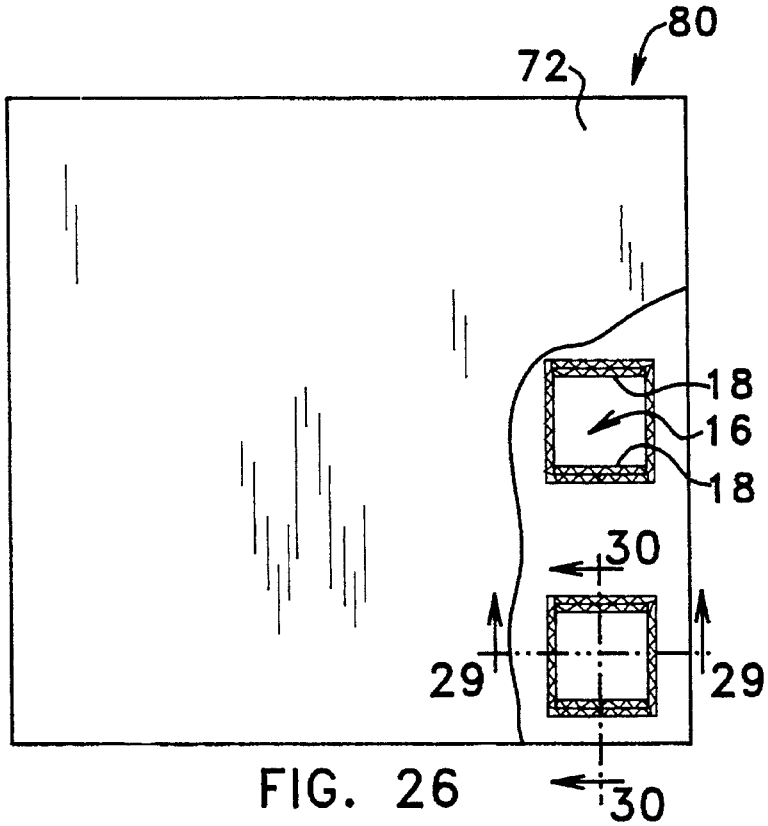
FIG. 26 is a top plan view depicting a cut-away section showing the flutes of the primary support sheet panels surrounded by the support members.
Figure 27:
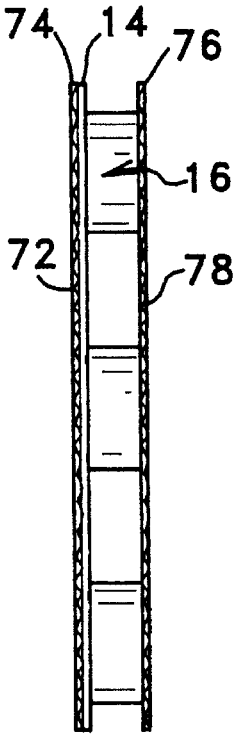
FIG. 27 is a side view of FIG. 26 showing the flutes of the top cover sheet running parallel with the panels of the bottom base sheet and normal to the flutes of the primary support sheet.
Figure 28:
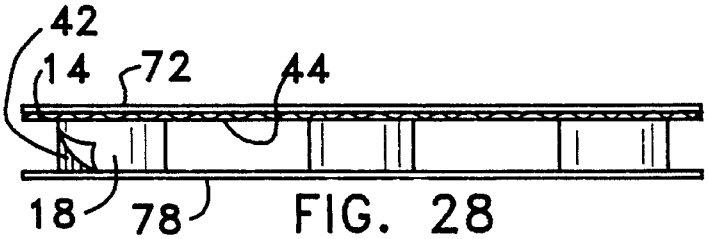
FIG. 28 is an end view of FIG. 26 showing the primary support sheet and panel flutes.
Figure 31:
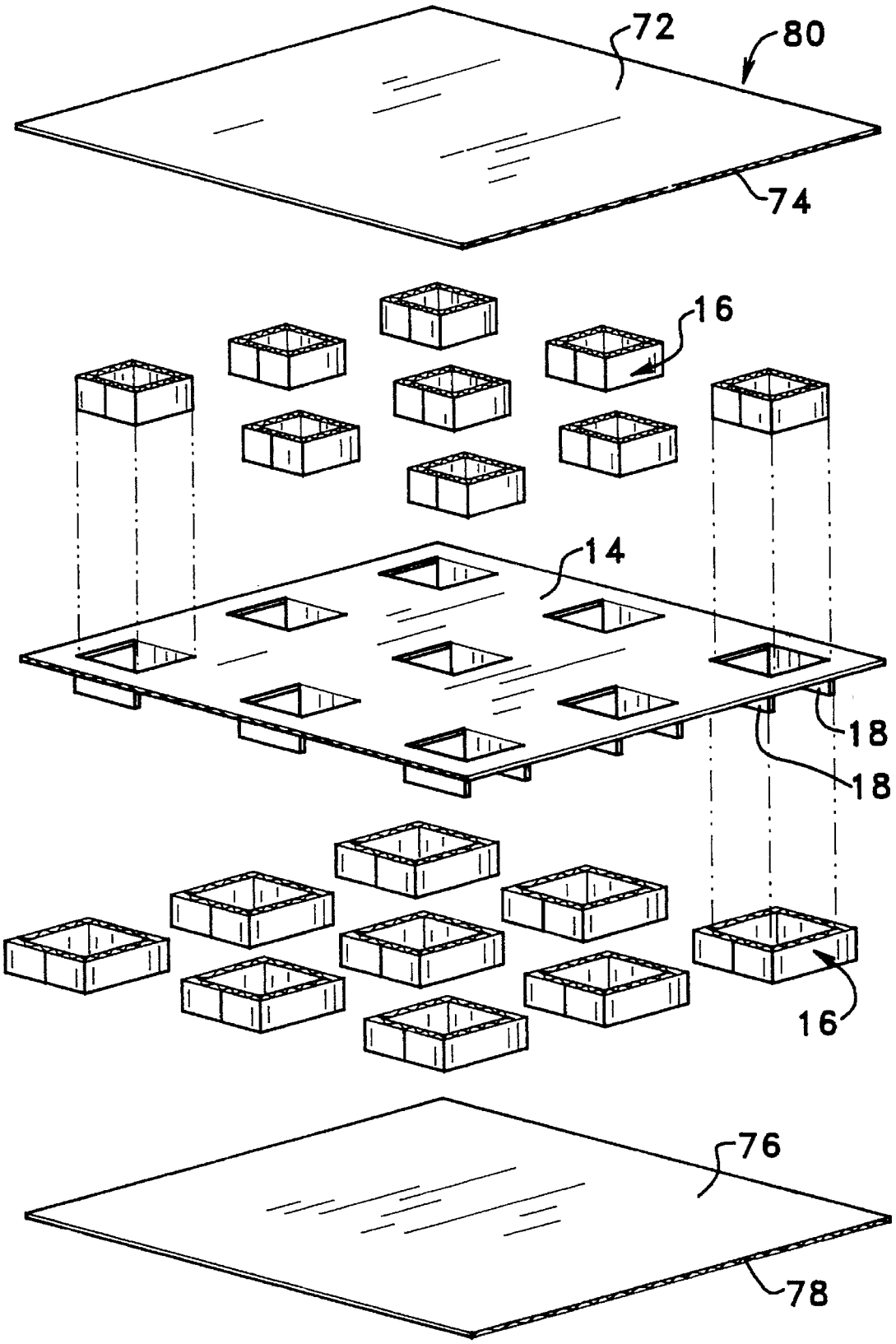
FIG. 31 is an explored perspective view showing alignment of support members within the primary support sheet panels and support members around the primary support sheet panels, and the alignment of a top cover sheet and bottom base sheet forming a triple sheet laminated corrugated pallet.

Another embodiment of the present invention combines the features of the triple sheet corrugated pallet 80 shown in FIGS. 19 and 25, by utilizing support members 16 inserted within and adhesively secured between the inner surfaces of the foldable panels 18, in conjunction with support members 16 surrounding and adhesively secured to the outer surface of the foldable panels 18 as best illustrated in FIG. 31.

Figure 32:
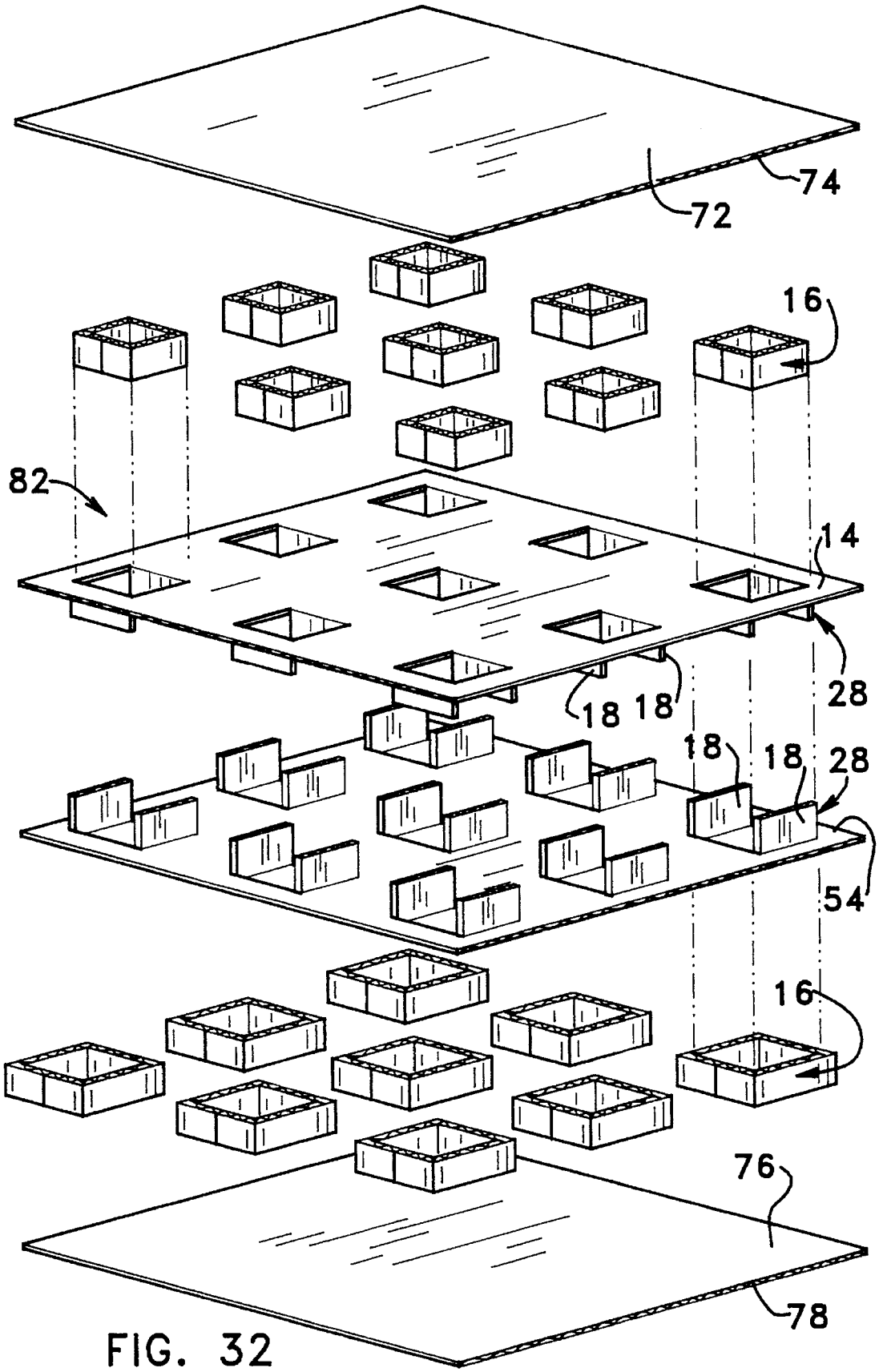
FIG. 32 is an elevational perspective view showing insertion of support members through the template cut and scored in a first primary support sheet and an inverted second primary support sheet rotated on its axis 90 degrees with respect to the first primary support sheet forming four panel legs thereinbetween, wherein the first and second primary support sheets are sandwiched between a top cover sheet and bottom base sheet.

Furthermore, an alternate version of the present invention is shown in FIG. 32 comprising a quadruple sheet corrugated pallet 82 which utilizes the same aforementioned first primary support panel 14 and second primary support sheet 68 as shown in FIG. 14; however, the second primary support sheet 68 is inverted and rotated 90 degrees with respect to the first primary support sheet 14 so that the cut and score lines of one sheet are perpendicular to the same cut and score lines of the other sheet. The second primary support sheet 68 is stacked upon the first primary support sheet 14 such that the squares of one are vertically juxtaposed upon the squares of the other sheet so that the foldable panels 18 of the first primary support sheet 14 extend through the openings formed in the second primary support sheet 46 and vice versa. Insertion of inner support members 16 through the sheets 14 and 68 from above or below expands the foldable panels 18 and simultaneously spreads the adhesive from the surface of the first primary support sheet 14 and/or second primary support sheet 46 onto the outer surface of the support member 16 to securely hold the support member 16 securely thereinbetween the four panels 18 forming the panel legs 26. The outer support members 16 is positioned around and adhesively attached to the panel legs 26 in conjunction with the inner support members 16 to provide additional structural support. Moreover, the first laminate sheet 54 forms a cover sheet which is adhesively secured to the edges of the inner and outer support members 16 and the surface of the primary support sheet 14. A base sheet 76 is adhesively secured to the bottom edges of the support members 16 and the surface of the second primary support sheet 68. It is contemplated that several laminate sheets 54 may be stacked together in combination with the primary support sheets 14, 68 and support members 16, to provide a simple, inexpensive, and efficient method of increasing the strength to weight ratio of the corrugated pallet 82.

Figure 33:
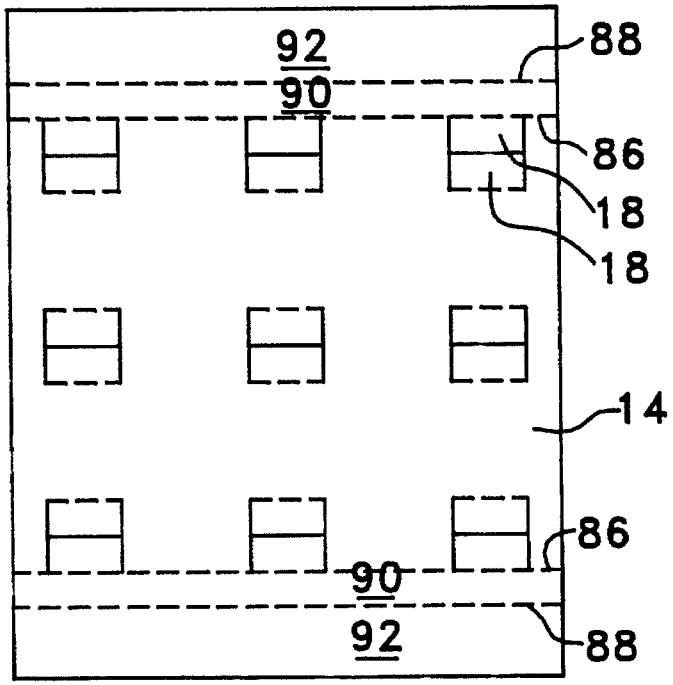
FIG. 33 is a top plan view of showing a primary support sheet having a plurality of perforations and scores therein forming side runners therefrom.
Figure 34:
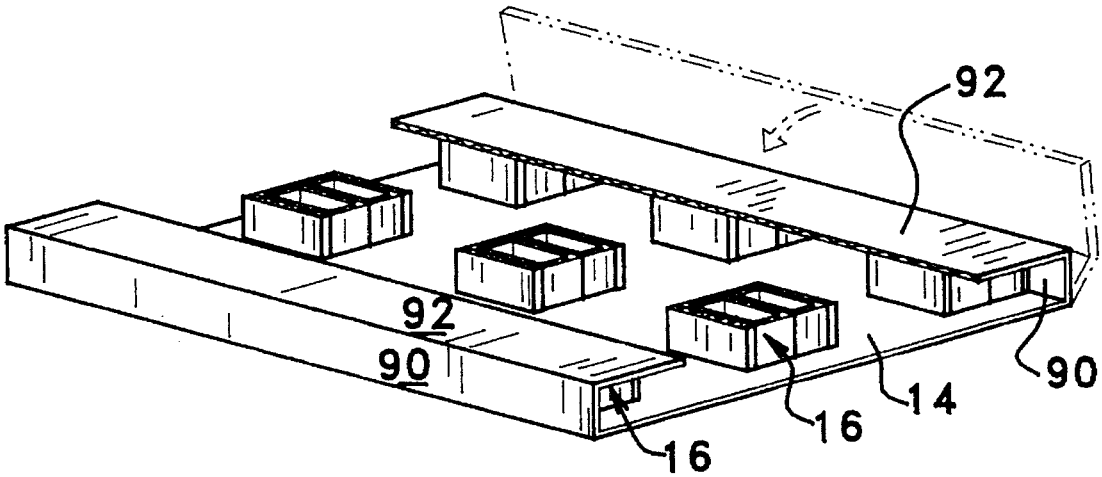
FIG. 34 is a bottom perspective view of FIG. 33 showing a single sheet corrugated pallet having a pair of outer panels folded downwardly and inwardly around the outer support members forming side runners.

As set forth in FIGS. 33 and 34, additional supporting structures such as side rails or side runners 84 may be fabricated in combination with the folding panels 18 from a single primary support sheet 14 or base sheet 76. The side runners 84 add substantial lateral stability and extra strength around the edge of the corrugated pallet 10 which is subjected to the greatest load strain and stress. Furthermore, the side runners 84 perform as guide means for guiding the lift truck forks and providing a means for orienting the skids during stacking. As shown in the drawings, the sheet 14 is perforated with a pair of spaced apart parallel score lines consisting of inner score line 86 and outer score line 88 forming an inner panel 90 and outer panel 92 on each side of the primary support sheet 14. The score line for the inner panel 90 is positioned near the score line of the outer support members 16 or support legs 26. As shown in FIG. 34, support members 16 or reinforced support members 48 are inserted and adhesively secured in-between or around the panel legs 26 of a primary support sheet 14 or adhesively affixed to the bottom of a base sheet 76. The inner panels 90 and outer panels 92 are folded inwardly around the outer side panel legs 26 and support members 16 therein or therearound forming side rails 84 on each side of the corrugated pallet 10. It is contemplated that a base sheet 76 and/or top support sheet 72 may be used in combination with the primary support sheet 14 having side runners 84.

Figure 35:
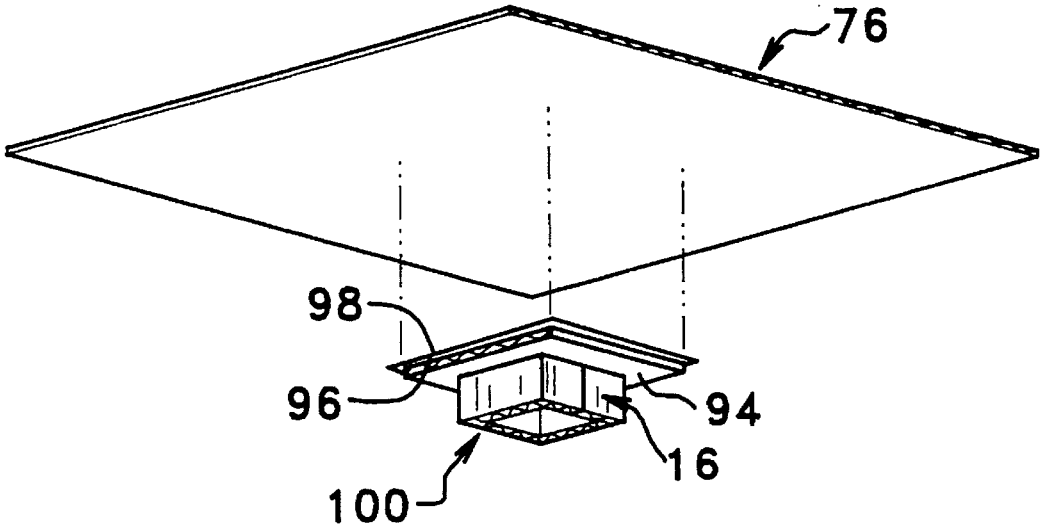
FIG. 35 is a perspective view of a support base member.
Figure 36:
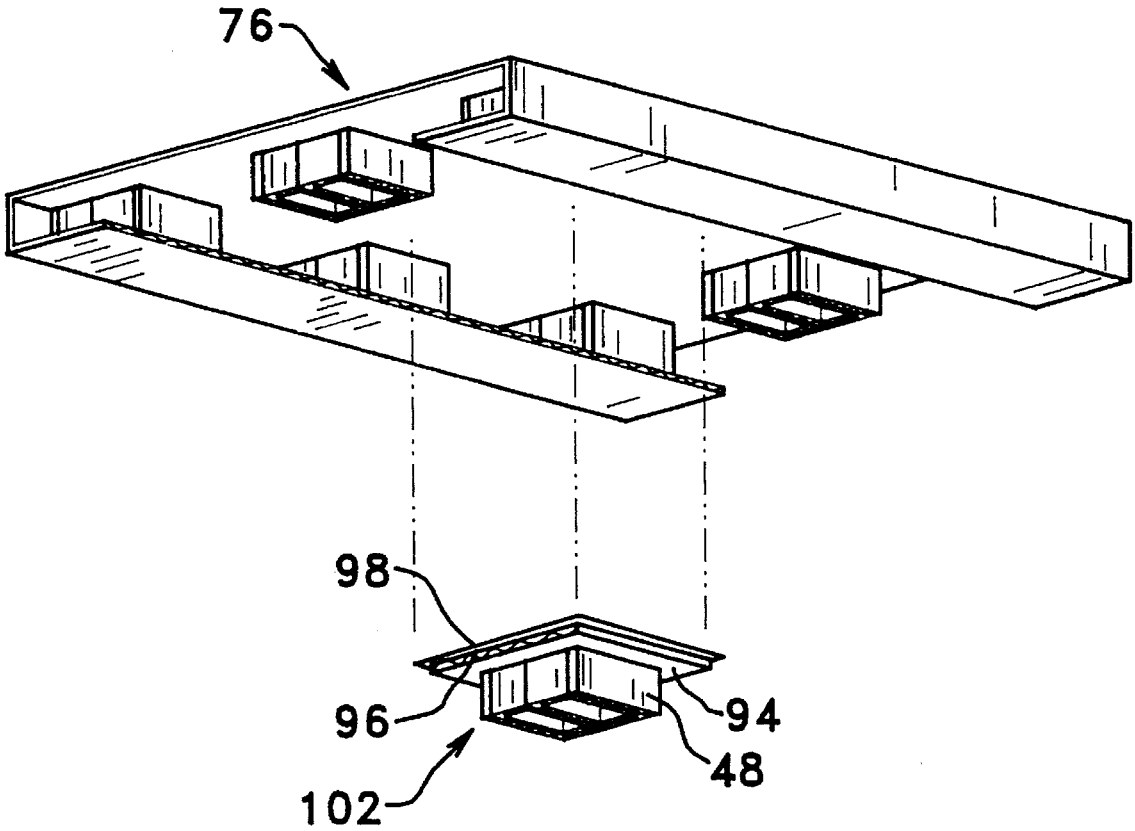
FIG. 36 is a perspective view of a reinforced support base member.
Figure 37:
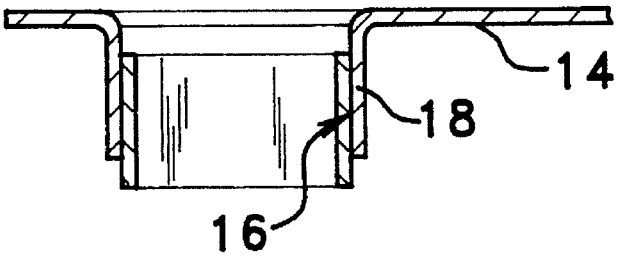
FIG. 37 is a sectional view taken along lines 37—37 of FIG. 9 showing the sides of the support member extending below the surface of the primary support panel disposed between a pair of foldable panels.
Figure 38:
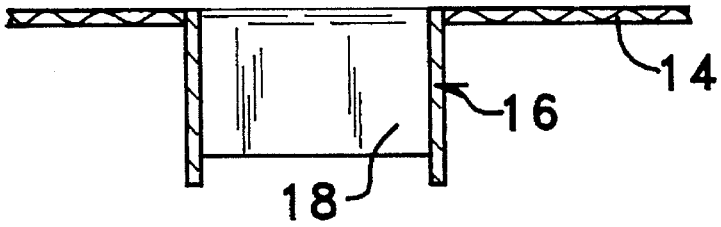
FIG. 38 is a sectional view taken along lines 38—38 of FIG. 9 showing the sides of the support member extending below the surface of one of the primary support panels.
Figure 39:
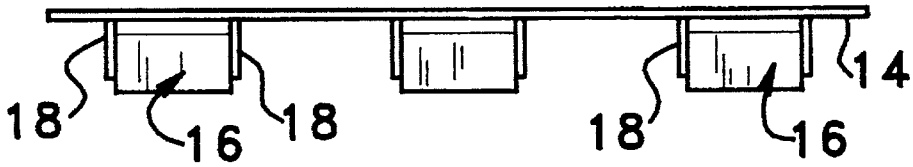
FIG. 39 is an elevated side view showing the sides of the support member extending below the surface of the primary support panel disposed between a pair of foldable panels.
Figure 40:
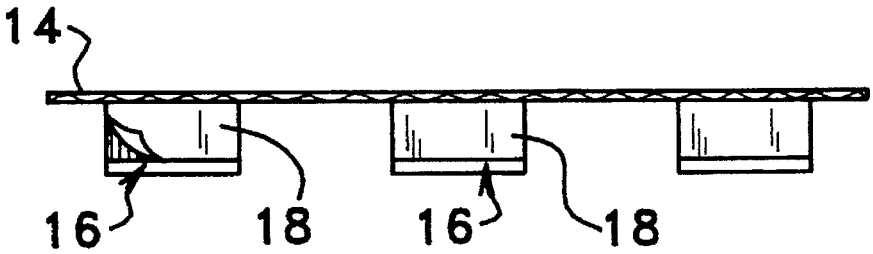
FIG. 40 is an elevated end view showing the support member extending below the surface of one of the primary support panels.

The support members 16 and reinforced support members 48 may also be adhesively secured to a pre-cut panel of flat corrugated material 94 having an adhesive backing 96 covered with a nonstick film, or waxed paper material 98 forming an independent support base member 100 or reinforced support base member 102 as shown in FIGS. 35 and 36. The base member 100 can be attached to the bottom of a primary support sheet 14 for additional structural support or a plurality of base members 100 may be attached to the bottom of a base sheet 76 for support, for stacking, or for providing a means to hold the corrugated pallet 10 up off of the floor.

FIGS. 41–68 illustrate several embodiments of multi-layered leg-wrap corrugated pallets 104 having longitudinal leg-wrap support members 106 extending the entire length of the corrugated pallet 104. The leg-wrap corrugated pallets 104 provide utilize longitudinal support means extending across the width of the pallet 10 and are adapted for portably moving extending the tines of a fork lift between the leg-wraps 106 and/or through passageways formed through the leg-wraps 106.

Figure 44:
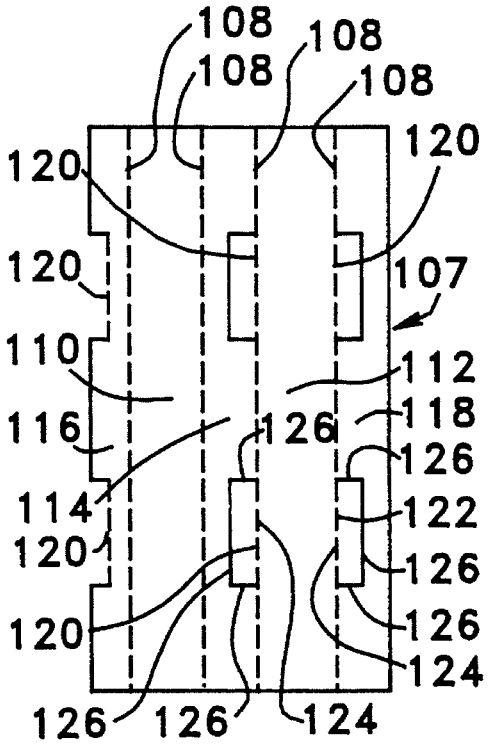
FIG. 44 is a top plan view of the corrugated panel of FIG. 43, showing a leg-wrap having the score lines shown in phantom lines.
Figure 49:
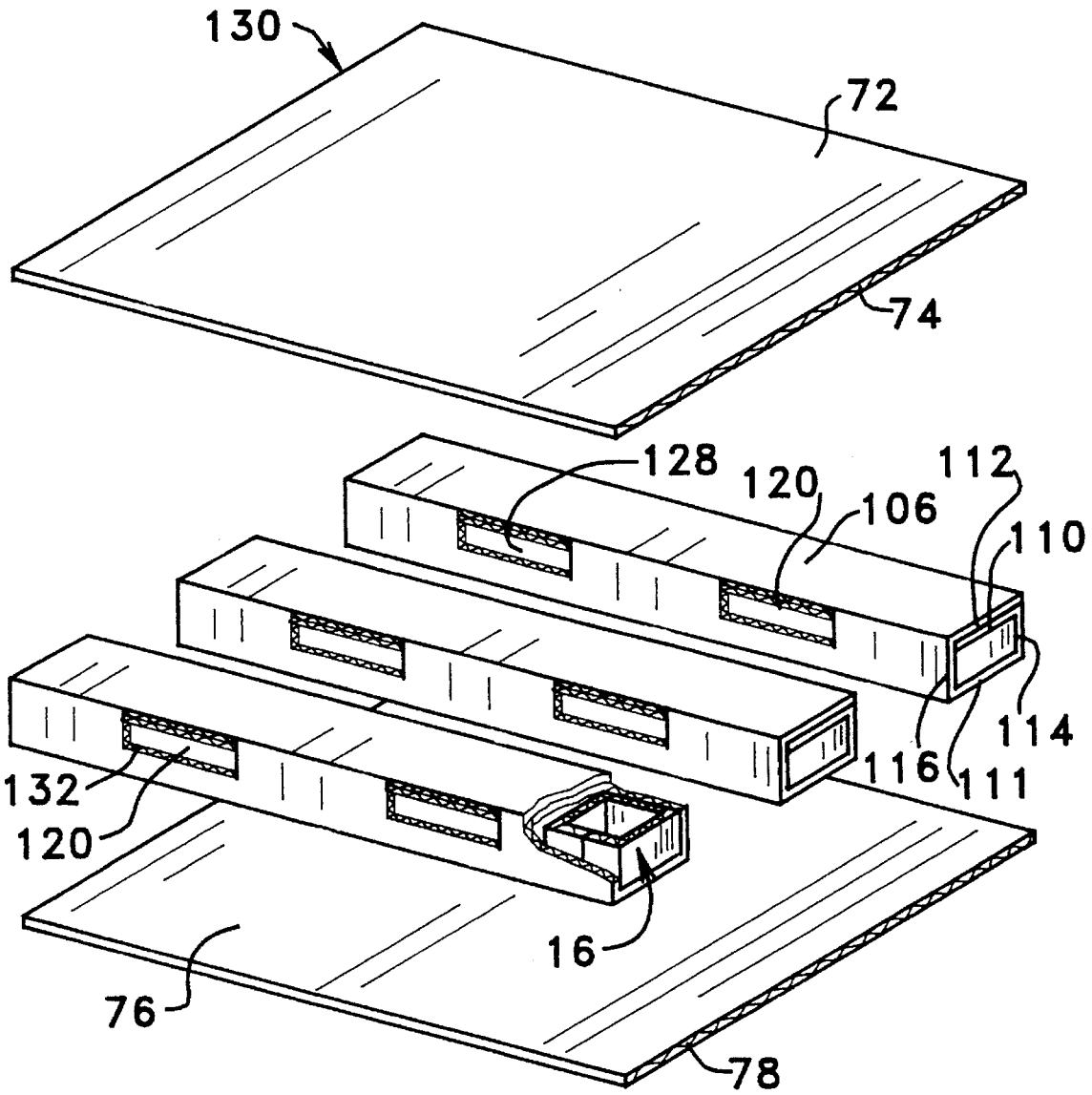
FIG. 49 is an exploded perspective view showing another preferred embodiment of a corrugated leg-wrap pallet in accordance with the present invention having a single multi-ply corrugated support sheet and single layer base sheet, and showing a cut-away view of one of the leg-wraps showing a support member disposed therein.
Figure 51:
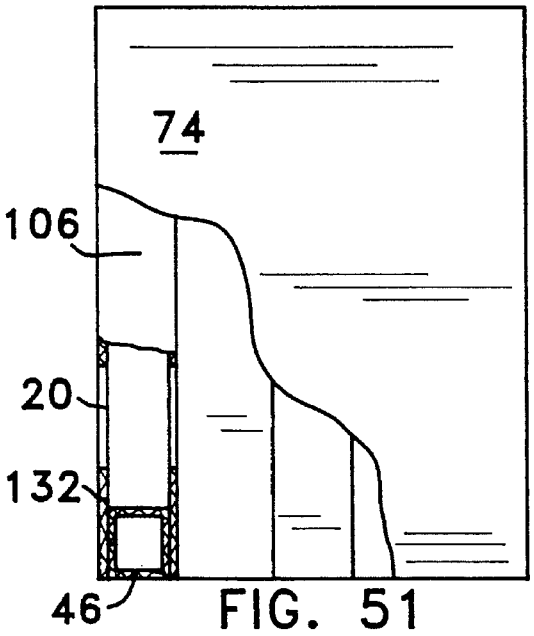
FIG. 51 is a top plan cut-away view of the corrugated pallet of FIG. 49, showing the leg-wrap and support member disposed therein.
Figure 52:
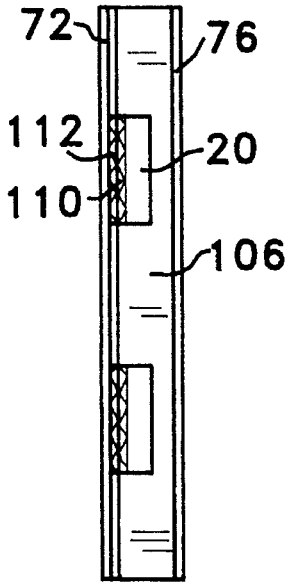
FIG. 52 is an end view of the corrugated pallet of FIG. 49, showing the slots formed within the leg-wraps.
Figure 53:
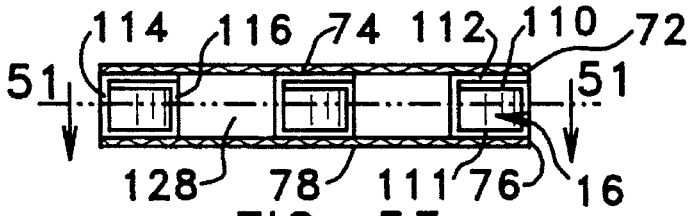
FIG. 53 is a sectional side view of FIG. 51, showing the position of the leg-wraps and support members disposed therein.
Figure 54:
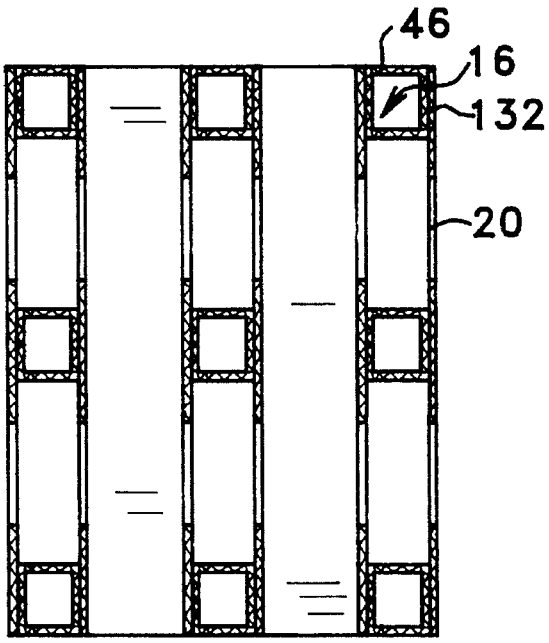
FIG. 54 is a cutaway plan top view of the corrugated pallet of FIG. 49, showing the position of the leg-wraps and the support members therein disposed between the passageways formed by the slots.
Figure 50:
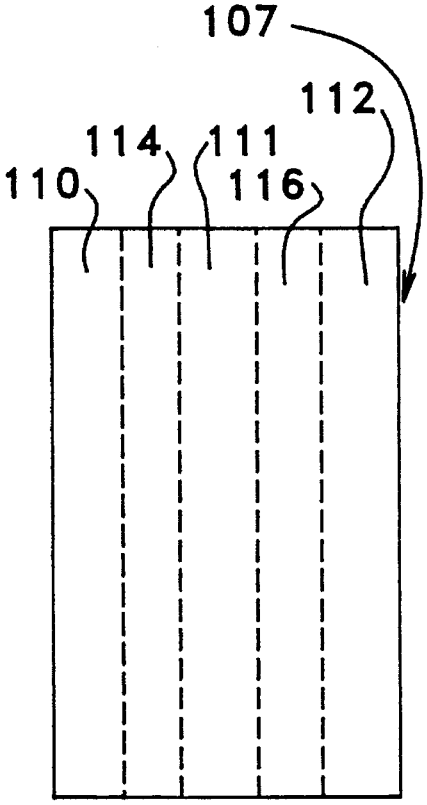
FIG. 50 is a top plan view of the corrugated panel of FIG. 49, showing a leg-wrap having the score lines shown in phantom lines.
Figure 55:
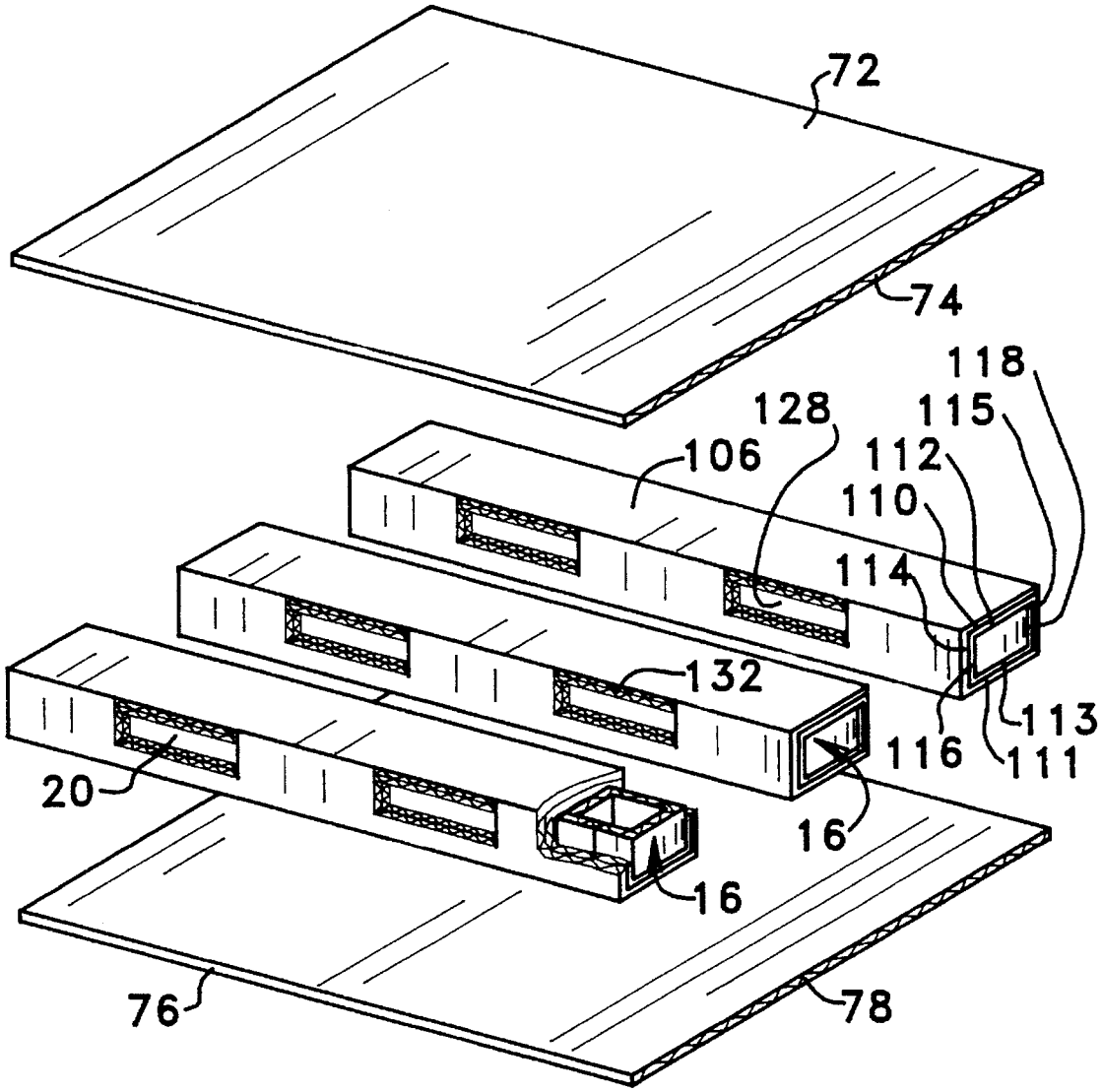
FIG. 55 is an exploded perspective view showing another preferred embodiment of a corrugated leg-wrap pallet in accordance with the present invention having a single multi-ply corrugated support sheet and single layer base sheet, and showing a cut-away view of one of the leg-wraps showing a support member disposed therein.
Figure 57:
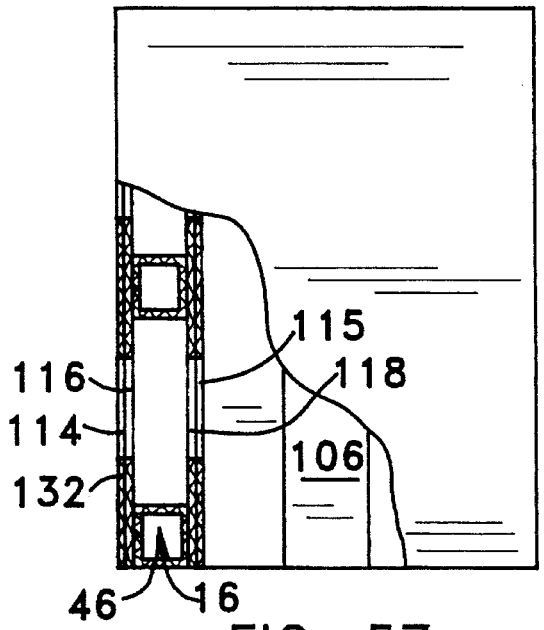
FIG. 57 is a top plan cut-away view of the corrugated pallet of FIG. 55, showing the leg-wrap and support member disposed therein.
Figure 58:
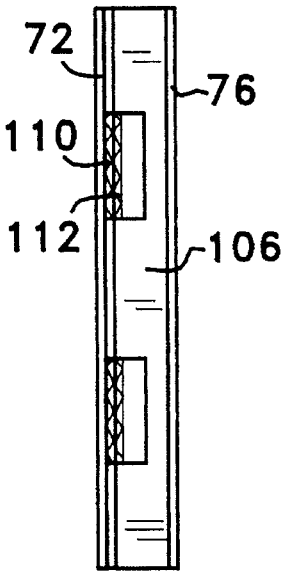
FIG. 58 is an end view of the corrugated pallet of FIG. 55, showing the slots formed within the leg-wraps.
Figure 59:
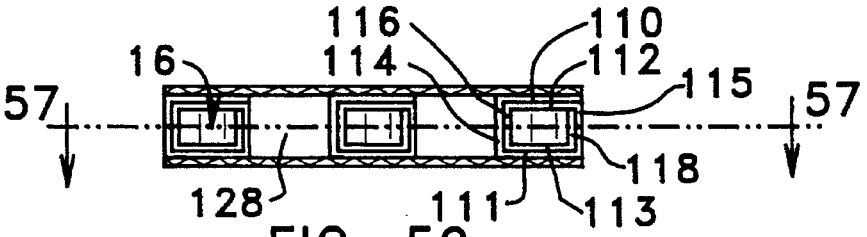
FIG. 59 is a sectional side view of FIG. 57, showing the position of the leg-wraps and support members disposed therein.
Figure 60:
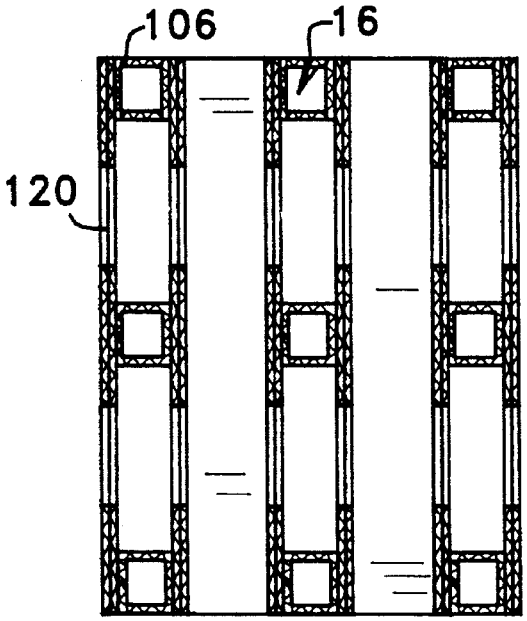
FIG. 60 is a cutaway plan top view of the corrugated pallet of FIG. 55, showing the position of the leg-wraps and the support members therein disposed between the passageways formed by the slots.
Figure 56:
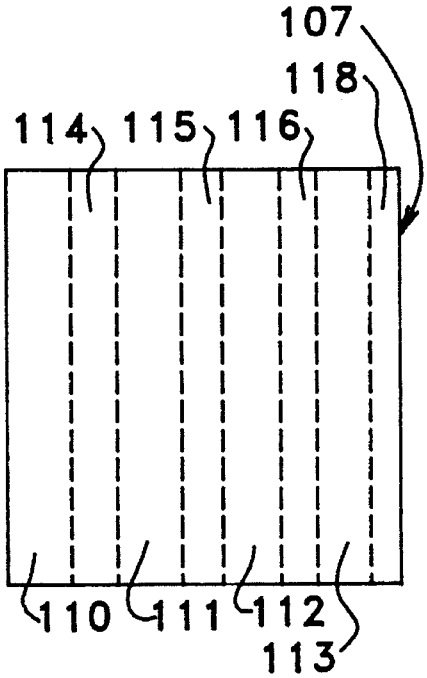
FIG. 56 is a top plan view of the corrugated panel of FIG. 55, showing a leg-wrap having the score lines shown in phantom lines.

As shown in FIG. 44, the leg wrap support members 106 are fabricated by scoring a multi-ply corrugated leg-wrap sheet 107 on one side and bending the sheet 107 around the plurality of spaced apart and parallel scores forming creases 108 therealong and panel sections thereinbetween. The creases 108 separate the corrugated sheet 107 into wide top and bottom panel sections having alternating narrow side sections thereinbetween. More particularly, a first wide panel section 110 and second wide panel section 112 are hingeably connected together by a first narrow side panel section 114 positioned thereinbetween. A second narrow side panel section 116 is hingeably connected to the first wide panel section 110, and a third narrow side panel section 118 is hingeably connected to the second wide panel section 112. A holding means, such as a pressure sensitive adhesive or water soluble glue, is applied between the outer narrow side panel sections 116 and 118 and the panel sections joining them together and forming the rectangular shaped leg-wrap supports 106.

Furthermore, transverse slots 120 or transverse slots with break-away flaps 122 may be formed in the leg-wrap supports 108 simultaneously with the scoring process. The flaps 120 and slots with flaps 122 are adapted to accommodate the tines of a fork lift truck.

Figure 41:
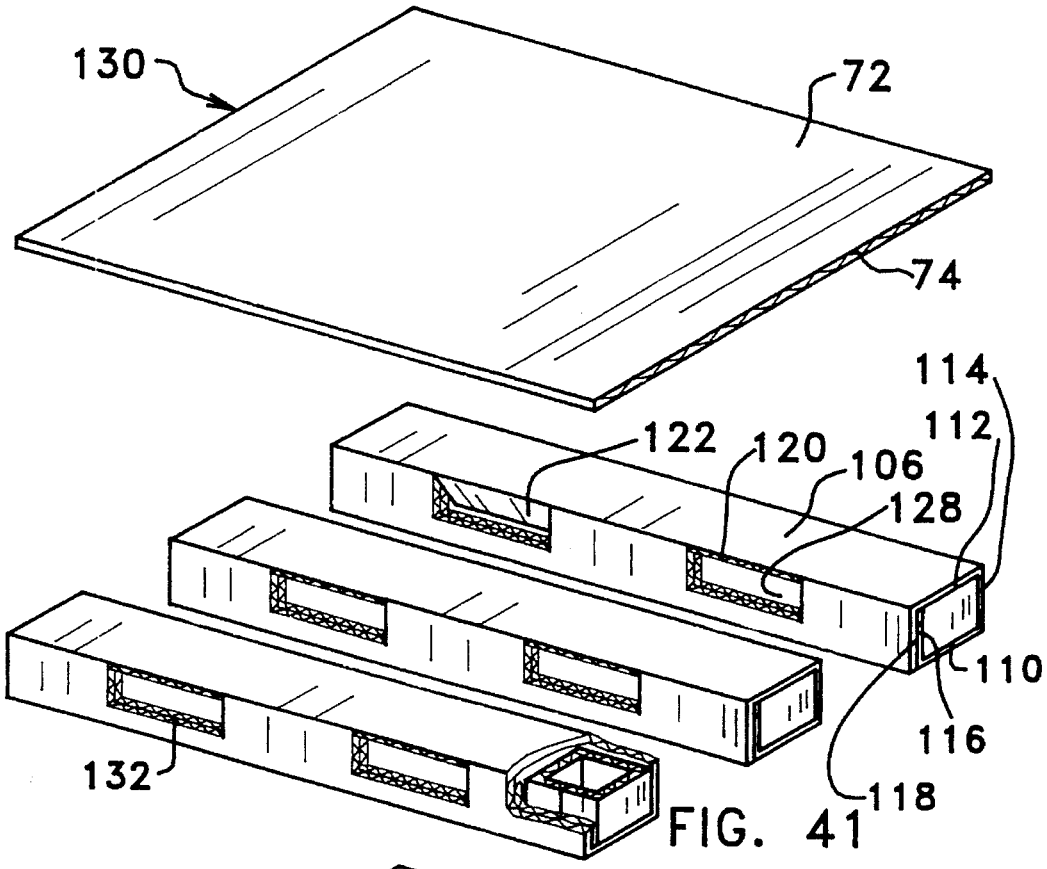
FIG. 41 is an exploded perspective view showing a corrugated leg-wrap pallet in accordance with the present invention having a single multi-ply corrugated support sheet and showing a cut-away view of one of the leg-wraps showing a support member disposed therein.
Figure 42:
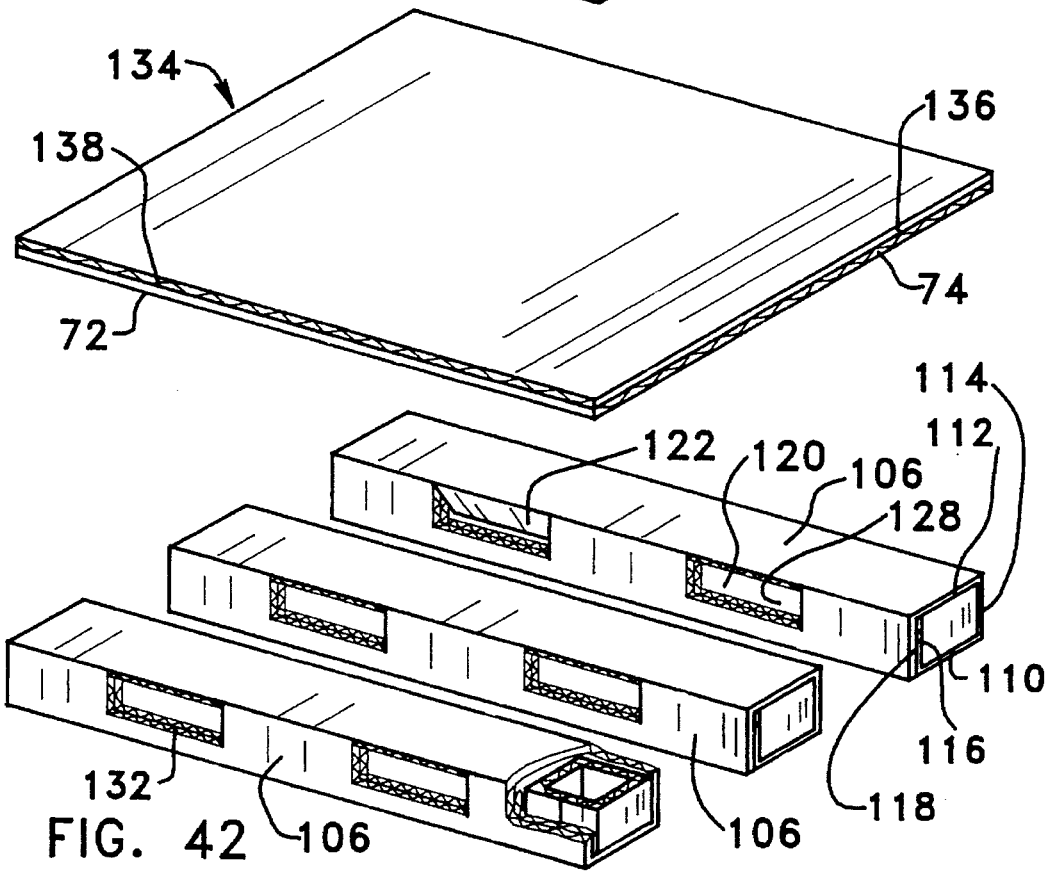
FIG. 42 is an exploded perspective view showing a corrugated leg-wrap pallet in accordance with the present invention having a multiple layers of multi-ply corrugated support sheets and showing a cut-away view of one of the leg-wraps showing a support member disposed therein.
Figure 43:
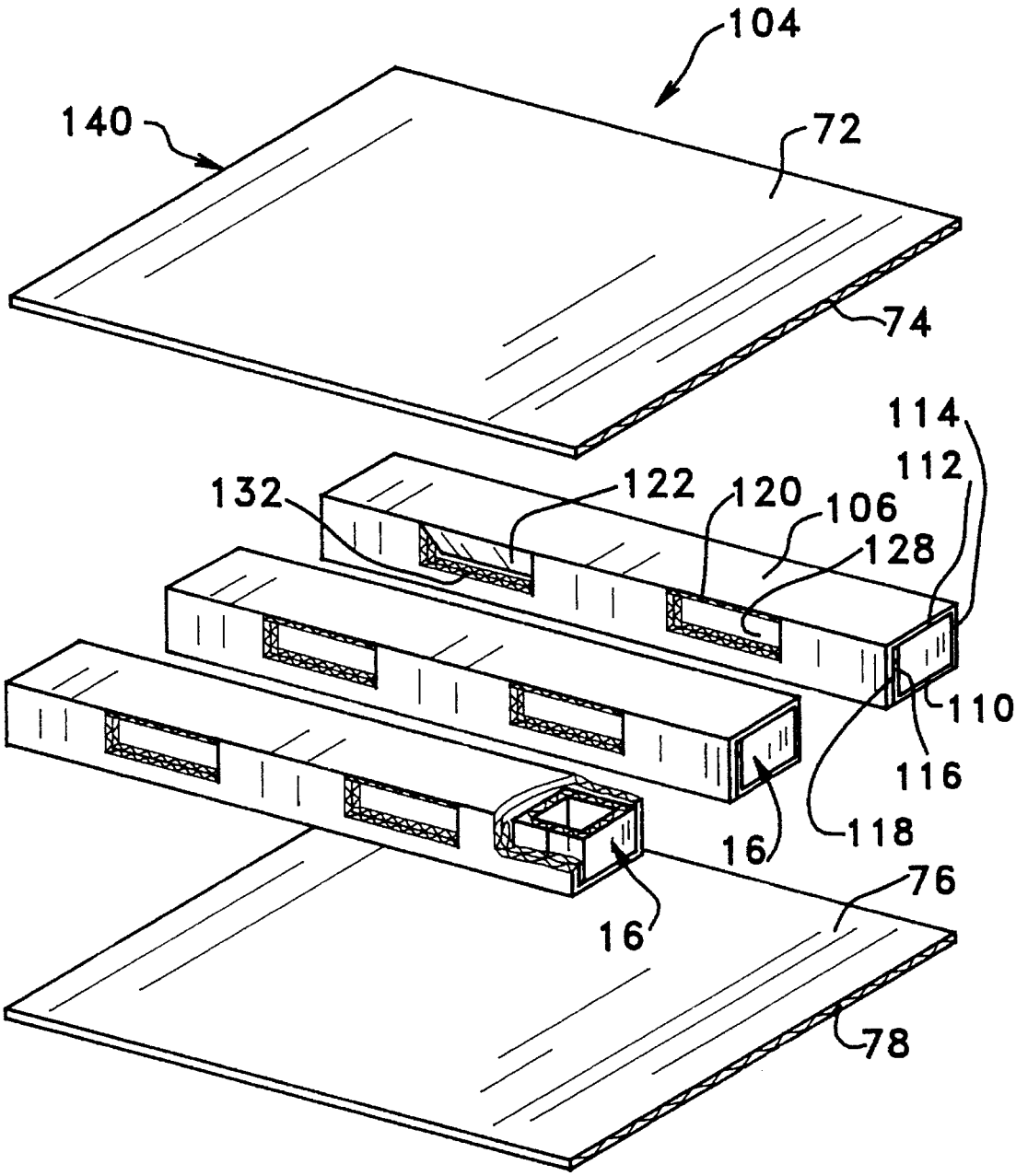
FIG. 43 is an exploded perspective view showing a corrugated leg-wrap pallet in accordance with the present invention having a single multi-ply corrugated support sheet and single layer base sheet, and showing a cut-away view of one of the leg-wraps showing a support member disposed therein.
Figure 45:
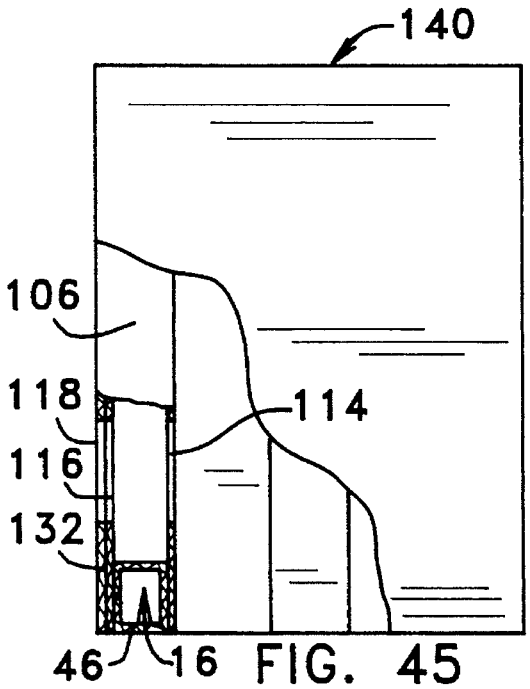
FIG. 45 is a top plan cut-away view of the corrugated pallet of FIG. 43, showing the leg-wrap and support member disposed therein.
Figure 46:
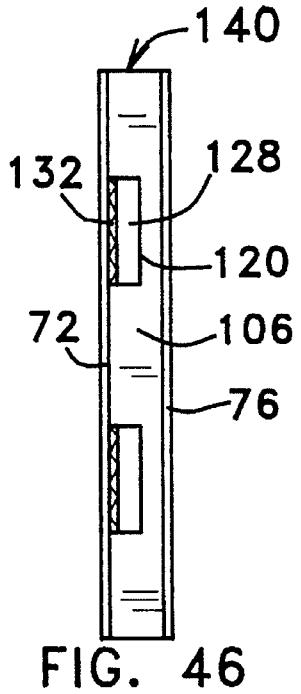
FIG. 46 is an end view of the corrugated pallet of FIG. 43, showing the slots formed within the leg-wraps.
Figure 47:
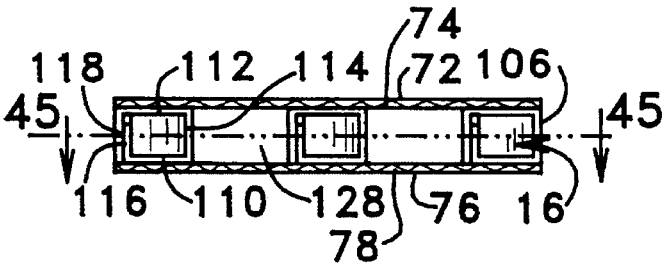
FIG. 47 is a sectional side view of FIG. 45, showing the position of the leg-wraps and support members disposed therein.
Figure 48:
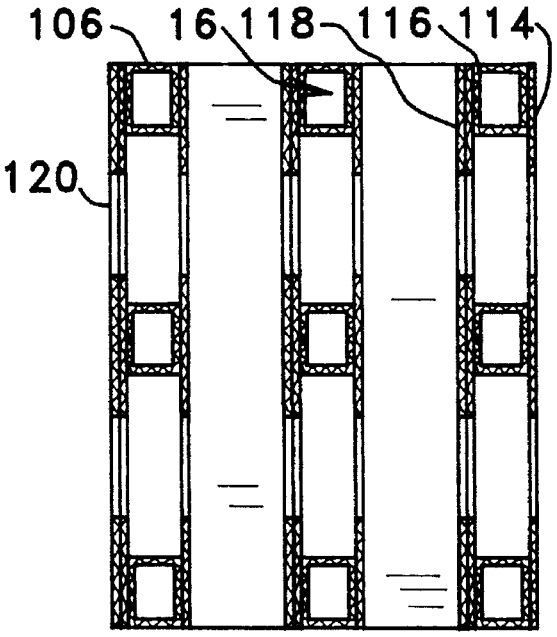
FIG. 48 is a cutaway plan top view of the corrugated pallet of FIG. 43, showing the position of the leg-wraps and the support members therein disposed between the passageways formed by the slots.

The slots with flaps 122 are formed by creating score lines 124 into and cuts 126 through the corrugated sheet 107 as best shown in FIGS. 41–44. The slots 120 are formed by stamping cuts 126 through the corrugated sheet 107. The panel sections 110–118 are folded along the creases 108 into position aligning the slots 120, 122 formed therein providing a generally rectangular shaped passageway or conduit 128 extending normal to the longitudinal axis of the leg-wrap 108 through the vertical side panel sections 114–118. The slots 120, 122 are sized to provide the necessary clearance according to the width and thickness of a typical fork lift tine. The slots 120,122 are formed in the top portion of the narrow side panel sections 114–118 so that lift truck forks inserted into the slots 120, 122, lift upwardly distributing the upward force on the underside of the wide top panel section 110 of the leg-wrap 106 as best illustrated in FIGS. 41–43.

The leg-wrap corrugated pallets 104 shown in FIG. 41–43, incorporate at least two leg-wraps 106, and preferably three leg-wraps 106, spaced apart in parallel alignment. The leg-wraps 106 may be attached to a support surface comprising sheets or panels by using holding means such as staples, rivets, tape, interlocking tabs formed therein, etc.; however the preferred attachment means is by use of a biodegradable or incineratable adhesive such as water soluble or solvent soluble glue. The leg-wraps 106 may also be fabricated having a pressure-sensitive adhesive backing 96 covered with a nonstick film, or waxed paper material 98 forming an independent leg-wrap support 106 attachable to the bottom of any type of skid or pallet 10 for additional structural support.

In FIG. 41, a first multi-ply corrugated support sheet 72 forms a top cover sheet attached to, preferably by adhesive bonding, the top surface of the leg-wrap 106. The first laminate support sheet 72 is usually aligned so that the first support sheet flutes 74 run perpendicular to the leg-wrap flutes 132 to maximize the strength of the double layer leg-wrap corrugated pallet 130.

The multi-layer leg-wrap corrugated pallet 134 illustrated in FIG. 42 utilizes a second multi-ply corrugated support sheet 136 usually rotated 90 degrees before adhesion to the top surface of the first support sheet 72 so that the second support sheet flutes 138 run perpendicular to the first support sheet flutes 74 to increase the strength of the pallet 134.

A multi-ply corrugated base sheet 76 may be attached by holding means, such as by an adhesive, to the bottom surface of the leg-wraps 106 of the single layer leg-wrap corrugated pallet 130 shown in FIG. 43 to form a corrugated leg-wrap sandwich pallet 140. The base sheet 76 is usually aligned so that the base sheet flutes 78 run perpendicular to the leg-wrap flutes 132 to maximize the strength of the leg-wrap sandwich pallet 140. Moreover, one or more base sheets 76 may be added to the double layer leg-wrap corrugated pallet 134 to provide additional strength and lateral stability to the corrugated leg-wrap pallets 104.

FIGS. 45–48 show the corrugated leg-wrap sandwich pallet 140 of FIG. 43 in more detail. The pallet 140 of the preferred embodiment includes a plurality of support members 16 as shown in FIGS. 43, 45, 47, and 48 inserted into the leg-wraps 106 with the support member flutes 46 normal to the plane of the support sheets. The support members 16 are positioned at about the distal ends and in the central portions of the leg-wrap 106 in a staggered formation so as not to interfere with the insertion of the tines of the fork lift. Reinforced support members 48, as described heretofore, are utilized in place of the support members 16 depending upon the weight of the payload to be supported by the corrugated pallet 140. The support members 16, 48 are generally adhesively secured within the leg-wrap 106 during the fabrication of the leg-wraps 106 so that the panel sections 110–118 are wrapped around the support members 16, 48 therein.

The leg-wraps 106 shown in FIGS. 43–48 feature a five sided leg-wrap 106 utilizing three narrow panel sections 114–118. This arrangement provides the maximum strength utilizing the minimum amount of material.

The leg-wraps 106 shown in FIGS. 49–54 feature a five sided leg-wrap 106 utilizing three wide panel sections 110, 111, and 112 connected to two narrow panel sections 114 and 116 positioned thereinbetween and constructed in accordance with the process described hereinbefore. This arrangement provides a double layer of corrugated material in the upper portion of the leg-wrap 106 by folding and adhesively securing wide panel section 112 with wide panel section 110. The embodiment shown herein provides additional reinforcement in the area of the leg-wrap 106 between the support sheet 72 and the tines of the fork lift.

The leg-wraps 106 shown in FIGS. 55–60 feature an eight sided leg-wrap 106 utilizing four wide panel sections 110, 111, 112, and 113 connected to four narrow panel sections 114,115,116, and 118 positioned thereinbetween and constructed in accordance with the process described hereinbefore. This arrangement provides a double layer of corrugated material around the entire periphery of the leg-wrap 106 by folding and adhesively securing the overlapping wide panel sections, 110, 111, 112, and 113 together; and by folding and adhesively securing the overlapping narrow panel sections 114, 115, 116, and 118 together. The embodiment shown herein provides additional structural support substantially increasing the strength of the leg-wrap corrugated pallet 104 therewith.

Figure 61:
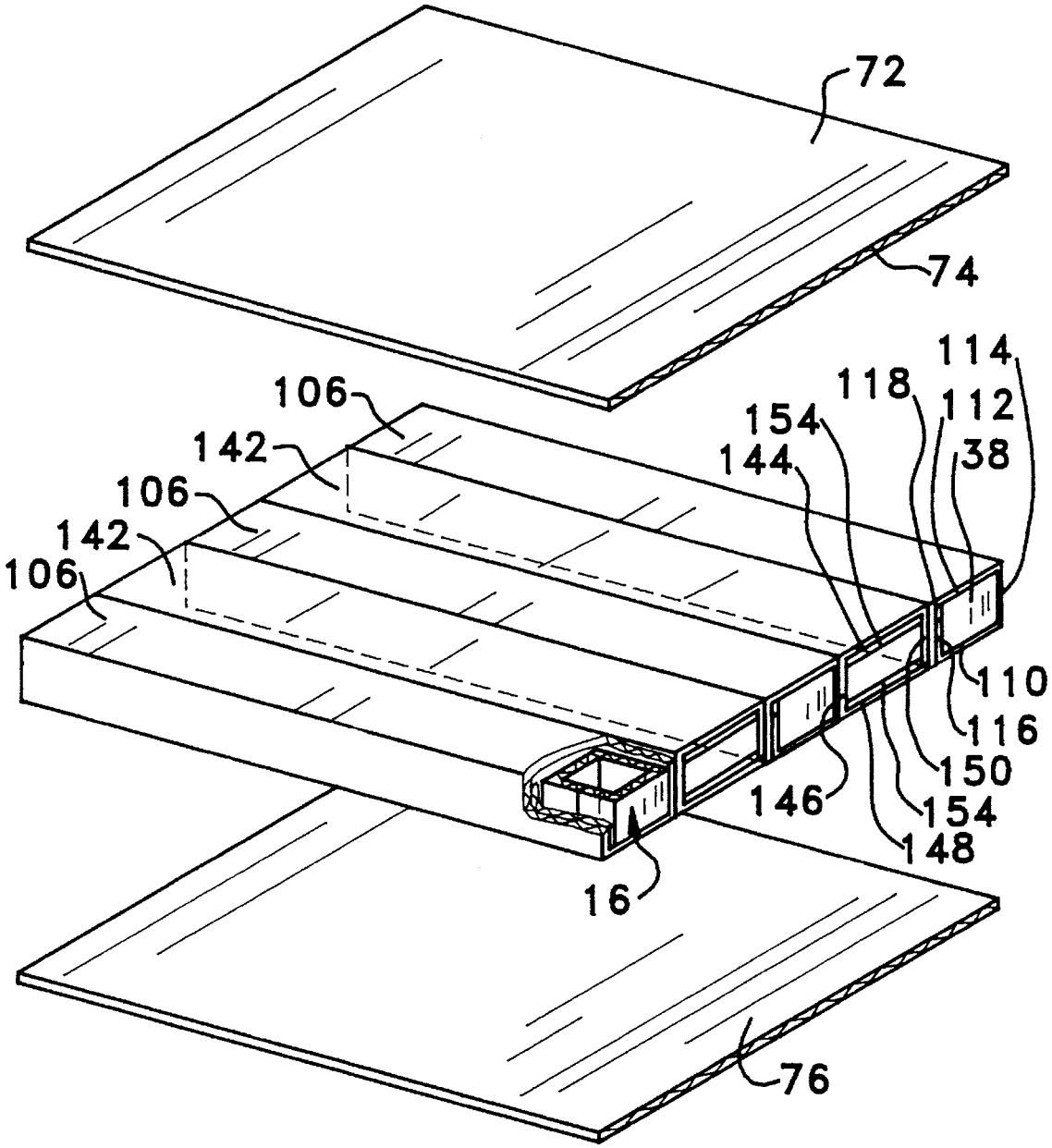
FIG. 61 is an exploded perspective view showing another preferred embodiment of a corrugated leg-wrap pallet in accordance with the present invention having a single multi-ply corrugated support sheet and single layer base sheet, a cut-away view of one of the leg-wraps showing a support member disposed therein, and support conduits disposed inbetween the leg-wrap supports and the support and base sheets.
Figure 62:
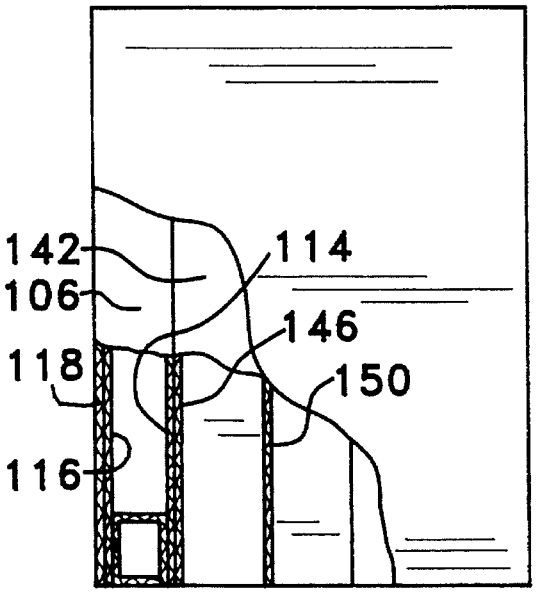
FIG. 62 is a top plan cut-away view of the corrugated pallet of FIG. 61, showing the leg-wrap, support member, and support conduit disposed therein.
Figure 63:
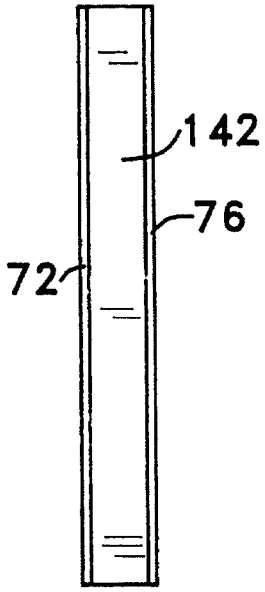
FIG. 63 is an end view of the corrugated pallet of FIG. 61, showing the smooth exterior surface of the leg-wraps.
Figure 64:
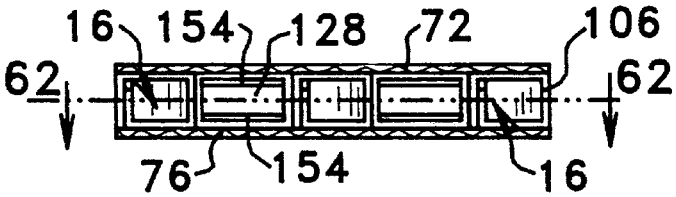
FIG. 64 is a sectional side view of FIG. 62 showing the position of the leg-wraps and support members disposed therein and the support conduits positioned between the leg-wrap supports.
Figure 65:
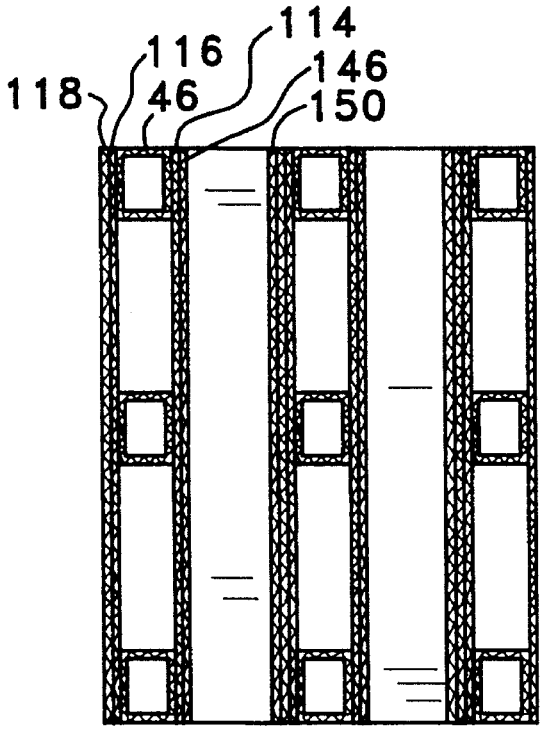
FIG. 65 is a cutaway plan top view of the corrugated pallet of FIG. 61, showing the flutes of and position of the leg-wraps support members disposed therein, and the conduit supports positioned between the leg-wrap supports.

As shown in FIGS. 61–65, a corrugated conduit support 142 is formed in the substantially the same manner as the leg-wraps 106 without the slots 120. The simplest embodiment utilizes a panel (not shown) having only four panel sections: an end wide panel section 144 connected to an inner narrow panel section 146 which is connected to a wide inner panel section 148 which is connected to an end narrow panel section 150. Folding the panel sections 144, 146, 148, and 150 around spaced apart score lines formed therein creates crease lines and forms a generally rectangular shaped corrugated conduit support 142 which is sized for insertion inbetween the leg-wraps 106 (containing support members therein) of the leg-wrap corrugated pallets 104 to provide additional support. The conduit supports 142 are secured therein utilizing a friction fit, or an adhesive may be utilized therewith. As shown in FIG. 61, the corrugated pallet 152 formed thereby does not utilize slots 120; however, the hollow conduit supports 142 provide an insertion means for the tines of a fork lift. Omission of the slots 120 further strengthens the structural strength of the corrugated pallet 152 fabricated in this manner. Of course, multiple layers of corrugated material may be used to form the conduit supports 142, such as shown in FIGS. 61–65 using additional support panels 154 in the top and bottom of the conduit supports 142 and secured therein by a pressure fit, friction fit, or fastening means such as an adhesive. The conduit supports 142 may also be fabricated with overlapping panel sections as described heretofore in the fabrication of the leg-wraps 106.

The leg-wraps 106 and/or conduit supports 142 may also be utilized with additional supporting structures having side rails or side runners 84 fabricated in combination with a support sheet 72, a single primary support sheet 14, or base sheet 76 when utilizing folding panels 90, 92 as described heretofore. The side runners 84 add substantial lateral stability and extra strength around the edge of the corrugated pallet 10 which is subjected to the greatest load strain and stress.

Figure 66:
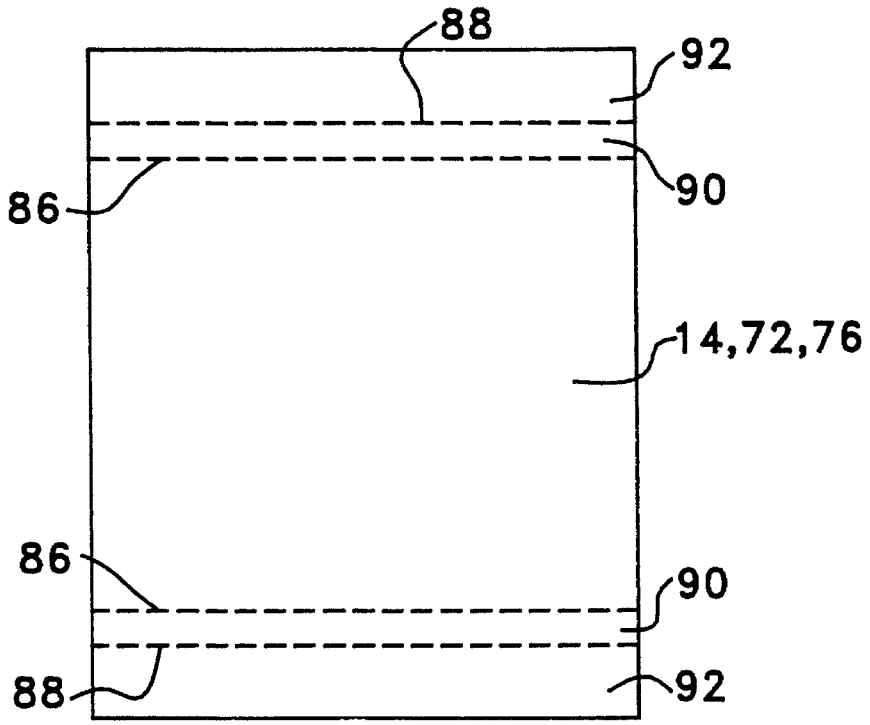
FIG. 66 is a top plan view of a corrugated support sheet having spaced apart parallel score lines formed therein and positioned near each end.
Figure 67:
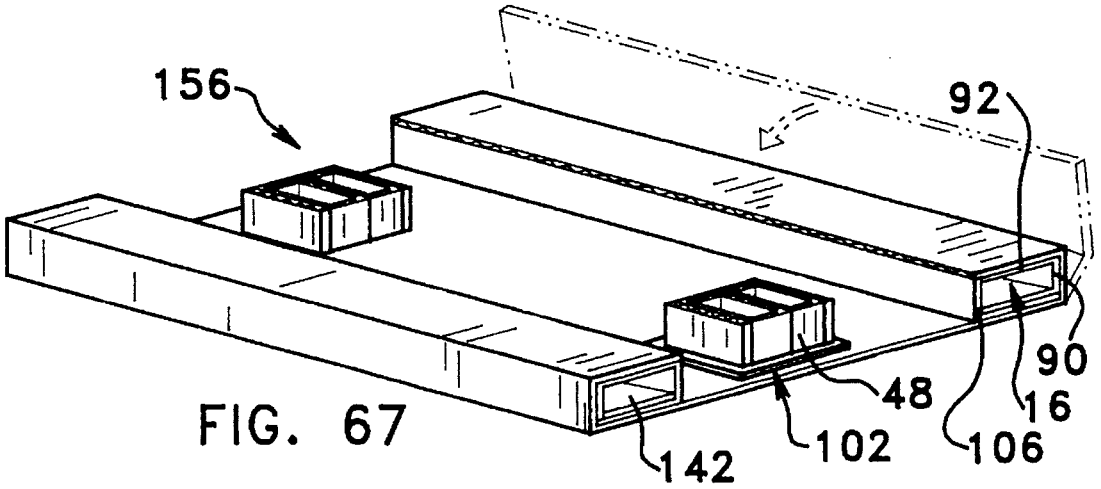
FIG. 67 is a perspective view showing the bottom portion of a leg-wrap corrugated pallet made in accordance with the present invention having base members adhesively secured along the central portion thereof and showing in phantom lines the ends of the support panel being folded inwardly around the leg-wrap supports.
Figure 68:
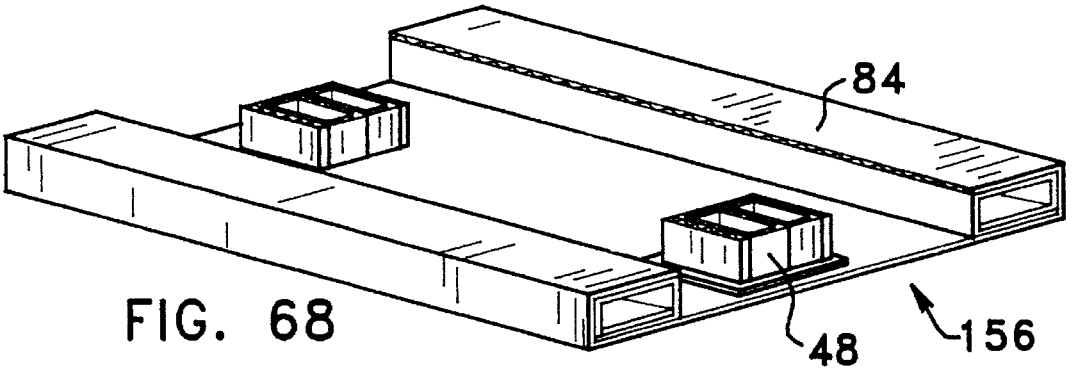
FIG. 68 is a perspective view showing the corrugated leg-wrap pallet of FIG. 67 having side rails formed around the leg-wrap supports.

As shown in the FIG. 66, the corrugated support sheet 72, 76 is perforated with a pair of spaced apart parallel score lines consisting of inner score line 86 and outer score line 88 forming an inner panel 90 and outer panel 92 on each side of the support sheet 72, 76 forming creases therein. As shown in FIGS. 67–68, leg-wraps 106 and/or conduit supports 142 are inserted and adhesively affixed to the bottom of the support sheet 72 or base sheet 76. The inner panels 90 and outer panels 92 are folded inwardly around the leg-wraps 106 or conduit supports 142 forming side rails 84 on each side of the corrugated pallet 10. It is contemplated that additional support sheets 72 and/or base sheets 76 may be used in combination with the corrugated pallet 156 having side runners 84.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims.

I claim:

1. A leg-wrap support member, comprising:

a sheet of corrugated material having a plurality of spaced apart parallel score lines formed therein, said sheet being folded inwardly forming creases along said score lines and at least five panel sections thereinbetween forming a generally rectangular shaped conduit having at least two of said panel sections overlapping and secured together with a holding means defining a top panel, bottom panel, and side panels, said generally rectangular shaped conduit including at least one corrugated support member disposed therein comprising a strip of corrugated material bent into a generally square configuration having flutes oriented normal to the surface of said top panel and said bottom panel defining a top fluted edge and a bottom fluted edge.

2. The leg-wrap support member of claim 1, including at least two pair of spaced apart and aligned transverse slots formed through said side panels of said generally rectangular shaped conduit.

3. The leg-wrap support member of claim 2, wherein at least one generally square corrugated support member is disposed inside of said generally rectangular shaped conduit inbetween said slots formed therein.

4. The leg-wrap support member of claim 1, including at least one transverse slot formed through said side panel of said generally rectangular shaped conduit.

5. The leg-wrap support member of claim 1, wherein said strip of corrugated material includes a plurality of score lines therein along the surface of one side parallel to said flutes for bending said strip into said at least one corrugated support member.

6. The leg-wrap support member of claim 4, wherein said side panel of said generally rectangular shaped conduit includes at least one break-away flap pivotally connected to one side of said slot.

7. The leg-wrap support member of claim 1, including at least two generally square corrugated support members being disposed inside said generally rectangular shaped conduit.

8. The leg-wrap support member of claim 1, wherein said holding means is selected from the group consisting of a water soluble adhesive, staples, rivets, interlocking tabs, solvent soluble adhesive, tape, and a pressure sensitive adhesive.

9. A corrugated leg-wrap pallet comprising:

a support surface comprising at least one multi-ply corrugated sheet;

at least one leg-wrap support member secured to the bottom of said support surface, said leg-wrap support member comprising a multi-ply corrugated sheet having a plurality of spaced apart parallel score lines formed therein, said sheet being folded inwardly forming creases along said score lines and at least five panel sections thereinbetween forming a generally rectangular shaped conduit having at least two of said panel sections overlapping and secured together with a holding means defining a top panel, bottom panel, and side panels, said generally rectangular shaped conduit including at least one corrugated support member disposed therein comprising a strip of corrugated material bent into a generally square configuration having flutes oriented normal to the surface of said top panel and said bottom panel defining a top fluted edge and a bottom fluted edge; and means for holding said at least one leg-wrap support member to said support surface.

10. The corrugated leg-wrap pallet of claim 9, wherein said means for holding is selected from the group consisting of a water soluble adhesive, staples, rivets, interlocking tabs, solvent soluble adhesive, tape, and a pressure sensitive adhesive.

11. The corrugated leg-wrap pallet of claim 9, including at least one support conduit comprising a sheet of corrugated material having a plurality of spaced apart parallel score lines formed therein, said sheet being folded inwardly forming creases along said score lines and at least four panel sections thereinbetween forming a generally rectangular shaped conduit complementary sized for insertion between two leg-wrap supports.

12. The leg-wrap corrugated pallet of claim 9, including at least two pair of spaced apart and aligned transverse slots formed through said side panels of said generally rectangular shaped conduit of said leg-wrap support member.

13. The leg-wrap corrugated pallet of claim 12, said at least one generally square corrugated support member being disposed inside of said generally rectangular shaped conduit of said leg-wrap support member inbetween said transverse slots formed therein.

14. The leg-wrap corrugated pallet of claim 9, wherein said support surface comprises a plurality of multi-ply corrugated sheets adhesively secured together, said sheets being stacked in alternating layers having the flutes aligned normal with respect to one another.

15. The leg-wrap corrugated pallet of claim 9, including at least one base sheet secured to the bottom of said at least one leg-wrap and means for holding said base sheet to said at least one leg-wrap.

16. The corrugated leg-wrap pallet of claim 15, wherein said means for holding is selected from the group consisting of a water soluble adhesive, staples, rivets, interlocking tabs, solvent soluble adhesive, tape, and a pressure sensitive adhesive.

17. The corrugated leg-wrap pallet of claim 9, including at least one corrugated support base member adhesively secured to the bottom of said support surface in combination with said at least one leg-wrap support member.

18. The corrugated leg-wrap pallet of claim 9, including at least one break-away flap pivotally connected to one side of said transverse slot.

19. The corrugated leg-wrap pallet of claim 9, wherein said strip of corrugated material includes a plurality of score lines therein along the surface of one side parallel to said flutes for bending said strip into said at least one corrugated support member.

20. The corrugated leg-wrap pallet of claim 9, wherein said support surface is scored forming a plurality of generally square apertures therein for inserting complimentary sized and shaped corrugated support members therethrough secured to panel flaps formed in the support sheet on either side of said aperture, said support surface including a plurality of spaced apart parallel score lines forming an inner side panel and outer side panel on opposing sides of said support surface, said inner side panel and said outer side panel being folded inwardly and wrapped around a plurality of said generally square corrugated support members forming side rails extending along each side of said support surface on each side of said at least one corrugated leg wrap support member.

21. The corrugated leg-wrap pallet of claim 20, wherein said support surface is scored forming a plurality of generally square apertures therein for inserting complimentary sized and shaped corrugated support members therethrough secured to panels formed in the support sheet on either side of said aperture, said corrugated support members being positioned inbetween said side rails.

22. The corrugated leg-wrap pallet of claim 9, wherein said support surface includes a pair of spaced apart parallel score lines forming an inner side panel and outer side panel on each side of said support surface, said inner side panel and said outer side panel being folded inwardly and wrapped around said leg-wrap support members forming side rails extending along each side of said support surface.

23. The corrugated leg-wrap pallet of claim 22, said inner side panel and said outer side panel being folded inwardly and wrapped around a plurality of generally square corrugated support members including at least one leg wrap support thereinbetween.

24. The corrugated leg wrap pallet of claim 17, including at least one corrugated support base member secured to said support surface positioned inbetween said side rails.

25. The corrugated leg wrap pallet of claim 24, wherein at least one corrugated support member is inserted through a square aperture formed within said support surface and secured to panels formed by the aperture, said corrugated support member being positioned inbetween said side rails.

26. A corrugated leg-wrap pallet comprising:

a support surface comprising at least one multi-ply corrugated sheet;

at least three leg-wrap support members secured to the bottom of said support surface, said leg-wrap support members comprising a multi-ply corrugated sheet having a plurality of spaced apart parallel score lines formed therein, said sheet being folded inwardly forming creases along said score lines and at least five panel sections thereinbetween forming a generally rectangular shaped conduit having at least two of said panel sections overlapping and secured together with a holding means defining a top panel, bottom panel, and side panels, said generally rectangular shaped conduit including at least one corrugated support member disposed therein comprising a strip of corrugated material bent into a generally square configuration having flutes oriented normal to the surface of said top panel and said bottom panel defining a top fluted edge and a bottom fluted edge;

said generally rectangular conduit of said leg-wrap support having at least two pair of spaced apart and aligned transverse slots formed through the sides thereof complementary sized and shaped to accommodate the tines of a lift truck; and means for holding said leg-wrap support members to said support surface.

27. The corrugated leg-wrap pallet of claim 26, wherein said means for holding is selected from the group consisting of a water soluble adhesive, staples, rivets, interlocking tabs, solvent soluble adhesive, tape, and a pressure sensitive adhesive.

* * * * *